US009814941B2

(12) United States Patent
Cohen et al.

(10) Patent No.: US 9,814,941 B2
(45) **Date of Patent: *Nov. 14, 2017**

(54) SPORT BALLS AND METHODS OF MANUFACTURING THE SPORT BALLS

(71) Applicant: Nike, Inc., Beaverton, OR (US)

(72) Inventors: Tal Cohen, Larchmont, NY (US); Geoffrey C. Raynak, Portland, OR (US); Vincent F. White, Beaverton, OR (US); Eleazar C. Chavez, Beaverton, OR (US)

(73) Assignee: NIKE, Inc., Beaverton, OH (US)

( * ) Notice: Subject to any disclaimer, the term of this patent is extended or adjusted under 35 U.S.C. 154(b) by 295 days.

This patent is subject to a terminal disclaimer.

(21) Appl. No.: 14/049,271

(22) Filed: Oct. 9, 2013

(65) Prior Publication Data

US 2014/0106912 A1 Apr. 17, 2014

Related U.S. Application Data

(62) Division of application No. 12/652,638, filed on Jan. 5, 2010, now Pat. No. 8,579,743.

(51) Int. Cl.
*A63B 39/00* (2006.01)
*A63B 41/10* (2006.01)
(Continued)

(52) U.S. Cl.
CPC ..... *A63B 41/10* (2013.01); *A63B 41/08* (2013.01); *A63B 45/00* (2013.01); *Y10T 156/1005* (2015.01)

(58) Field of Classification Search
CPC ..... A63B 41/10; A63B 41/08; A63B 45/00; Y10T 156/1005
(Continued)

(56) References Cited

U.S. PATENT DOCUMENTS 414,748 A 11/1889 Bentley
1,517,859 A 12/1924 O'Shea
(Continued)

FOREIGN PATENT DOCUMENTS

CN 101516455 A 8/2009
EP 0 598 542 A2 5/1994
(Continued)

OTHER PUBLICATIONS

Response filed Jan. 4, 2015 in Chinese Patent Application No. 201080060248.7.
(Continued)

*Primary Examiner* — Vishu Mendiratta
(74) *Attorney, Agent, or Firm* — Quinn IP Law

(57) ABSTRACT

A sport ball may include a casing that incorporates a plurality of joined panel elements, which include a first panel element with a first edge and a second panel element with a second edge. The first edge and the second edge are welded to each other. In some configurations, the first panel element has a first edge with a projection that extends outward from the first edge, the second panel element has a second edge that is located adjacent to the first edge, and the projection of the first edge is located between the second edge and the bladder. In another configuration, the first edge and the second edge are formed to have rounded configurations. The sport ball may also include an intermediate layer and a bladder within the casing.

6 Claims, 23 Drawing Sheets

(51) Int. Cl.
*A63B 41/08* (2006.01)
*A63B 45/00* (2006.01)

(58) Field of Classification Search
USPC ..... 473/604, 605, 607
See application file for complete search history.

(56) References Cited

U.S. PATENT DOCUMENTS

| | | | | |
|---|---|---|---|---|
| 1,575,281 | A | 3/1926 | Rosenberg | |
| 1,917,535 | A | 7/1933 | Maynard | |
| 1,932,226 | A | 10/1933 | Pierce | |
| 1,967,908 | A | 7/1934 | Sneary | |
| 2,012,376 | A | 8/1935 | Caro | |
| 2,018,559 | A | 10/1935 | Everett | |
| 2,073,766 | A | 3/1937 | Suzuki | |
| 2,080,894 | A | 5/1937 | Levinson | |
| 2,126,220 | A | 8/1938 | Scudder | |
| 2,211,669 | A | 8/1940 | Reach | |
| 2,214,179 | A * | 9/1940 | Reach | A63B 41/08 156/147 |
| 2,300,441 | A | 11/1942 | Voit et al. | |
| 2,325,073 | A | 7/1943 | Reach | |
| 2,344,638 | A | 3/1944 | Reeder | |
| 2,945,693 | A | 7/1960 | Way | |
| 3,512,777 | A | 5/1970 | Henderson | |
| 4,154,789 | A | 5/1979 | Delacoste | |
| 4,436,276 | A | 3/1984 | Donahue | |
| 4,610,071 | A | 9/1986 | Miller | |
| 4,911,671 | A * | 3/1990 | Rogers | A63F 9/00 428/178 |
| D322,105 | S | 12/1991 | Ma | |
| 5,123,659 | A | 6/1992 | Williams | |
| 5,181,717 | A | 1/1993 | Donntag et al. | |
| 5,250,070 | A | 10/1993 | Parodi | |
| 5,320,345 | A * | 6/1994 | Lai | A63B 41/08 40/327 |
| 5,494,625 | A | 2/1996 | Hu | |
| 5,503,699 | A | 4/1996 | Ratner et al. | |
| 5,603,497 | A | 2/1997 | Louez | |
| 5,762,573 | A * | 6/1998 | Kennedy, III | A63B 45/02 40/327 |
| 5,779,578 | A | 7/1998 | Colandro | |
| 5,888,157 | A | 3/1999 | Guenther et al. | |
| 6,012,997 | A | 1/2000 | Mason | |
| 6,142,897 | A | 11/2000 | Lees | |
| 6,261,400 | B1 | 7/2001 | Kennedy, III | |
| 6,302,815 | B1 | 10/2001 | Shishido et al. | |
| 6,461,461 | B2 | 10/2002 | Kennedy, III | |
| 6,629,902 | B2 | 10/2003 | Murphy et al. | |
| 6,645,099 | B2 | 11/2003 | Gaff et al. | |
| 6,685,585 | B2 | 2/2004 | Shishido et al. | |
| 6,726,582 | B1 | 4/2004 | Kuo et al. | |
| 6,793,597 | B2 | 9/2004 | Awan | |
| 6,971,965 | B1 * | 12/2005 | Shishido | A63B 41/08 473/604 |
| 6,991,569 | B2 | 1/2006 | Dobrounig | |
| 7,005,025 | B2 | 2/2006 | Summers | |
| 7,029,407 | B2 | 4/2006 | Lee et al. | |
| 7,066,853 | B2 | 6/2006 | Chang | |
| 7,749,116 | B2 | 7/2010 | Tang et al. | |
| 8,192,311 | B2 | 6/2012 | White et al. | |
| 8,210,973 | B2 | 7/2012 | Rapaport et al. | |
| 8,579,743 | B2 * | 11/2013 | Cohen | A63B 41/08 473/604 |
| 8,608,599 | B2 * | 12/2013 | Raynak | A63B 41/08 473/603 |
| 2001/0002378 | A1 | 5/2001 | Calandro | |
| 2002/0086749 | A1 | 7/2002 | Ou | |
| 2003/0203780 | A1 | 10/2003 | Guenther et al. | |
| 2004/0053717 | A1 | 3/2004 | Awan | |
| 2004/0077288 | A1 | 4/2004 | Krysiak et al. | |
| 2004/0144477 | A1 | 7/2004 | Taniguchi et al. | |
| 2004/0229722 | A1 | 11/2004 | Liu | |
| 2005/0081982 | A1 | 4/2005 | Chen | |
| 2005/0229985 | A1 | 10/2005 | Saxenfelt | |
| 2006/0063622 | A1 | 3/2006 | Nurnberg et al. | |
| 2006/0229149 | A1 | 10/2006 | Goedoen | |
| 2006/0293132 | A1 | 12/2006 | Laliberty et al. | |
| 2007/0049434 | A1 | 3/2007 | Maziarz et al. | |
| 2008/0268989 | A1 | 10/2008 | Lalvani | |
| 2009/0325745 | A1 | 12/2009 | Rapaport et al. | |
| 2009/0325746 | A1 | 12/2009 | Raynak et al. | |
| 2009/0325747 | A1 * | 12/2009 | Ou | A63B 41/08 473/605 |
| 2010/0240479 | A1 * | 9/2010 | Raynak | A63B 41/08 473/604 |
| 2011/0165979 | A1 | 7/2011 | Cohen et al. | |
| 2012/0172160 | A1 | 7/2012 | Marc | |
| 2012/0316015 | A1 | 12/2012 | Wang | |
| 2013/0005520 | A1 | 1/2013 | Chang et al. | |

FOREIGN PATENT DOCUMENTS

| | | | |
|---|---|---|---|
| FR | 2 572 674 | A1 | 5/1986 |
| JP | 58-215335 | A | 12/1983 |
| JP | 60-122166 | U | 8/1985 |
| JP | 1-212578 | A | 8/1989 |
| JP | 10-337341 | A | 12/1998 |
| JP | 2007-209435 | A | 8/2007 |
| JP | 2008-080176 | A | 4/2008 |
| JP | 2009-153542 | A | 7/2009 |
| JP | 2013-090944 | A | 5/2013 |
| JP | 2013-090945 | A | 5/2013 |
| JP | 2013-516227 | A | 5/2013 |
| WO | 01/83047 | A1 | 11/2001 |
| WO | 2009/158103 | A1 | 12/2009 |
| WO | 2011/084289 | A1 | 7/2011 |

OTHER PUBLICATIONS

Intention to Grant dated Dec. 5, 2014 in European Patent Application No. 10803421.6.
International Search Report and Written Opinion dated Mar. 11, 2015 in PCT/US2014/072314.
Office Action dated Mar. 30, 2015 in Chinese Patent Application No. 201080060248.7.
Voluntary Amendments filed Apr. 9, 2015 in Divisional European Patent Application No. 15162955.7.
Second Office Action dated Oct. 20, 2014 in Chinese Patent Application No. 201080060248.7.
International Search Report and Written Opinion dated Jun. 10, 2011 in PCT/US2010/058904.
International Preliminary Report on Patentability dated Jul. 19, 2012 in PCT/US2010/058904.
Voluntary Amendments filed Jan. 17, 2013 in Japanese Patent Application No. 2012-547089.
Office Action dated Jan. 30, 2014 in Japanese Patent Application No. 2012-547089.
Response to Office Action filed Apr. 30, 2014 in Japanese Patent Application No. 2012-547089.
Voluntary Amendments filed Feb. 18, 2013 in Chinese Patent Application No. 201080060248.7.
Office Action dated Mar. 7, 2014 in Chinese Patent Application No. 201080060248.7.
Office Action dated Jan. 30, 2014 in Japanese Patent Application No. 2013-006574.
Response to Office Action filed Apr. 30, 2014 in Japanese Patent Application No. 2013-006574.
Office Action dated Jan. 30, 2014 in Japanese Patent Application No. 2013-006565.
Response to Office Action filed Apr. 30, 2014 in Japanese Patent Application No. 2013-006565.
Response filed Jul. 22, 2014 in Chinese Patent Application No. 201080060248.7.

* cited by examiner

SPORT BALLS AND METHODS OF MANUFACTURING THE SPORT BALLS

CROSS-REFERENCE TO RELATED APPLICATION

This application is a divisional of Cohen et al., U.S. Patent Application Publication No. 2011/0165979, published on Jul. 7, 2011, entitled "Sport Balls and Methods of Manufacturing the Sport Balls," the entire disclosure of which is incorporated herein by reference.

BACKGROUND

A variety of inflatable sport balls, such as a soccer ball, conventionally exhibit a layered structure that includes a casing, an intermediate layer, and a bladder. The casing forms an exterior portion of the sport ball and is generally formed from a plurality of durable and wear-resistant panels joined together along abutting edges (e.g., with stitching or adhesives). Although panel configurations may vary significantly, the casing of a traditional soccer ball includes thirty-two panels, twelve of which have a pentagonal shape and twenty of which have a hexagonal shape.

The intermediate layer forms a middle portion of the sport ball and is positioned between the casing and the bladder. Among other purposes, the intermediate layer may provide a softened feel to the sport ball, impart energy return, and restrict expansion of the bladder. In some configurations, the intermediate layer or portions of the intermediate layer may be bonded, joined, or otherwise incorporated into the casing as a backing material.

The bladder, which has an inflatable configuration, is located within the intermediate layer to provide an interior portion of the sport ball. In order to facilitate inflation (i.e., with pressurized air), the bladder generally includes a valved opening that extends through each of the intermediate layer and casing, thereby being accessible from an exterior of the sport ball.

SUMMARY

A sport ball is disclosed below as including a casing that forms an exterior surface of the sport ball. The casing incorporates a plurality of joined panel elements that include a first panel element with a first edge and a second panel element with a second edge. In general, the first edge and the second edge are welded to each other. In some configurations, the first panel element has a first edge with a projection that extends outward from the first edge, the second panel element has a second edge that is located adjacent to the first edge, and the projection of the first edge is located between the second edge and the bladder. In another configuration, the first edge and the second edge are formed to have a rounded configurations. The sport ball may also include an intermediate layer and a bladder within the casing.

A method of manufacturing a sport ball may include providing a plurality of panel elements that include a thermoplastic polymer material. The panel elements are welded to each other to join the panel elements. The panel elements are turned inside-out through an opening formed between a first edge and a second edge of at least two of the panel elements, and the edges are welded to each other. In some methods, the first edge has a projection that extends outward from the first edge. In another configuration, the first edge and the second edge are formed to have rounded configurations.

A sport ball may also have a casing that forms an exterior surface of the sport ball and includes a plurality of panel elements joined to each other with a plurality of first welds. At least one of the panel elements includes a second weld spaced from the first welds, and a cover layer is joined to the panel element and covers the second weld.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various sport ball configurations and methods relating to manufacturing of the sport balls. Although the sport ball is discussed and depicted in relation to a soccer ball, concepts associated with the configurations and methods may be applied to various types of inflatable sport balls. In addition to soccer balls, therefore, concepts discussed herein may be incorporated into basketballs, footballs (for either American football or rugby), volleyballs, and water polo balls, for example. A variety of non-inflatable sport balls, such as baseballs and softballs, may also incorporate concepts discussed herein.

General Sport Ball Configuration

Figure 1:
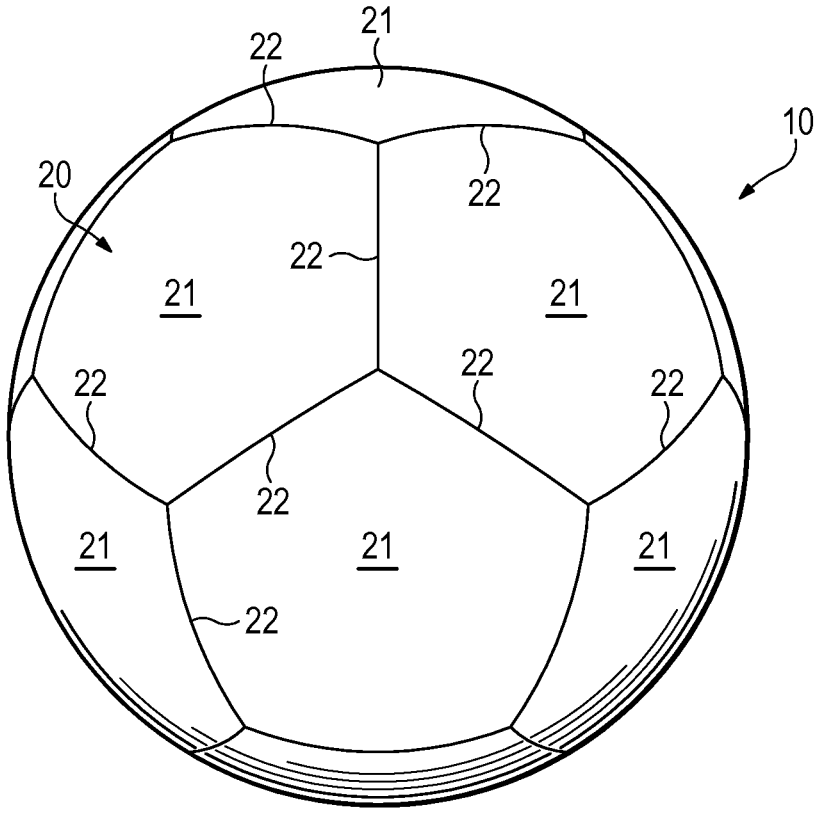
FIG. 1 is a perspective view of a sport ball.
Figure 2:
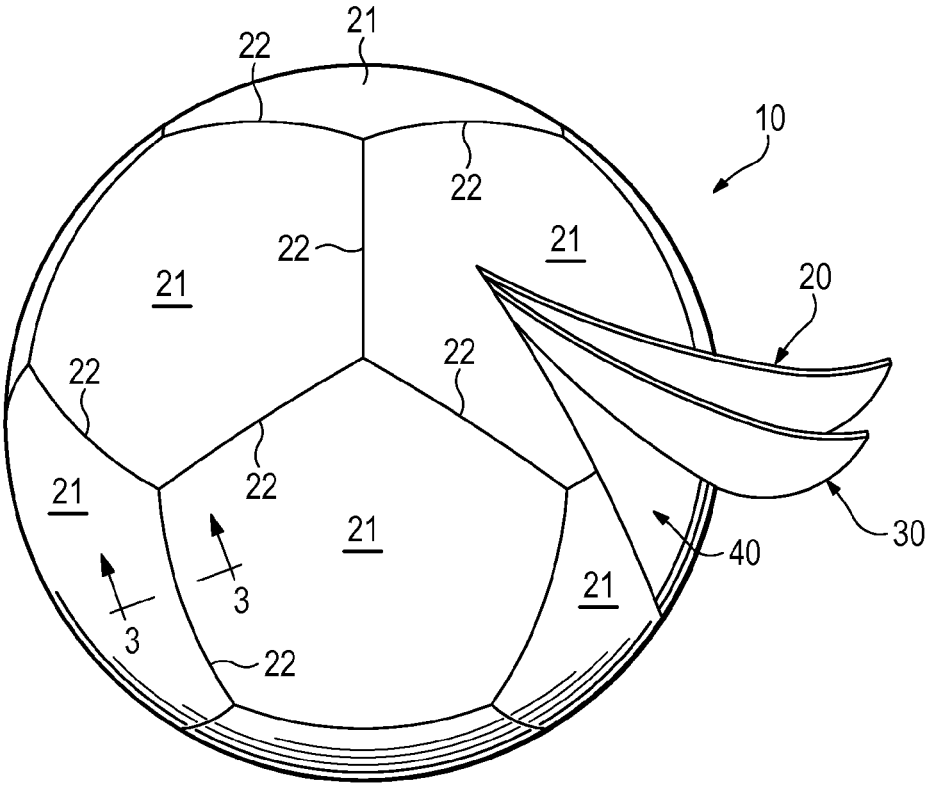
FIG. 2 is another perspective view of the sport ball.
Figure 3:
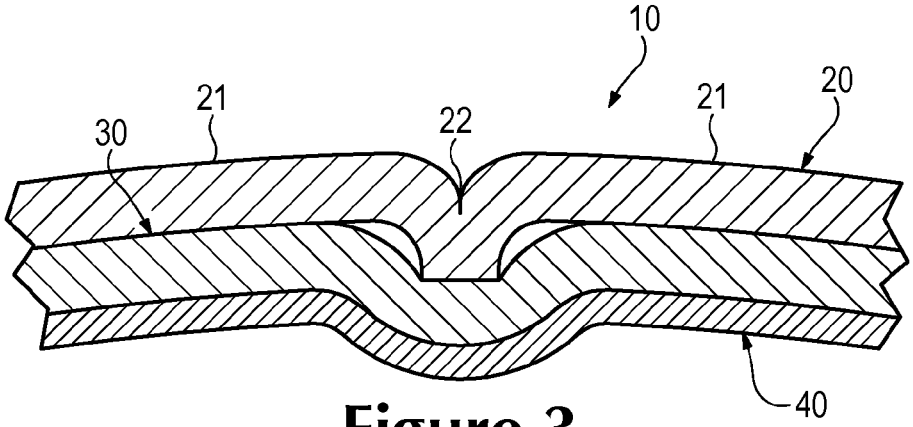
FIG. 3 is a cross-sectional view of a portion of the sport ball, as defined by section line 3-3 in FIG. 2.

A sport ball 10 having the general configuration of a soccer ball is depicted in FIGS. 1-3. Sport ball 10 exhibits a layered structure having (a) a casing 20 that forms an exterior portion of sport ball 10, (b) an intermediate layer 30 located within casing 20, and (c) an inflatable bladder 40 that forms an interior portion of sport ball 10. Upon pressurization, bladder 40 induces sport ball 10 to take on a substantially spherical shape. More particularly, pressure within bladder 40 causes bladder 40 to place an outward force upon intermediate layer 30. In turn, intermediate layer 30 places an outward force upon casing 20. In order to limit expansion of bladder 40 and also limit tension in casing 20, a portion of intermediate layer 30 may have a limited degree of stretch. In other words, bladder 40 places an outward force upon intermediate layer 30, but the stretch characteristics of intermediate layer 30 effectively prevent the outward force from inducing significant tension in casing 20. Accordingly, intermediate layer 30 restrains pressure from bladder 40, while permitting outward forces to induce a spherical shape in casing 20, thereby imparting a spherical shape to sport ball 10.

Casing 20 is formed from various panels 21 that are joined together along abutting sides or edges to form a plurality of seams 22. Although panels 21 are depicted as having the shapes of twelve equilateral pentagons, panels 21 may have non-equilateral shapes, concave or convex edges, or a variety of other shapes (e.g., triangular, square, rectangular, hexagonal, trapezoidal, round, oval, non-geometrical) that combine in a tessellation-type manner to form casing 20. In some configurations, sport ball 10 may have twelve pentagonal panels 21 and twenty hexagonal panels 21 to impart the general configuration of a traditional soccer ball. Selected panels 21 may also be formed of unitary (i.e., one piece) construction with adjacent panels 21 to form bridged panels that reduce the number of seams 22. Accordingly, the configuration of casing 20 may vary significantly.

A distinction between conventional casings and casing 20 relates to the manner in which panels 21 are joined to form seams 22. The panels of conventional sport balls may be joined with stitching (e.g., hand or machine stitching). In contrast, a welding process is utilized in the manufacture of sport ball 10 to join panels 21 and form seams 22. More particularly, panels 21 are at least partially formed from a polymer material, which may be a thermoplastic polymer material, and edges of panels 21 may be heated and bonded to each other to form seams 22. An example of the configuration of seams 22 is depicted in the cross-section of FIG. 3, wherein the welding process has effectively secured, bonded, or otherwise joined two of panels 21 to each other by combining or intermingling the polymer material from each of panels 21. In other configurations, some of panels 21 may be joined through stitching, or various seams 22 may be supplemented with stitching.

One advantage of utilizing a welding process to form seams 22 relates to the overall mass of sport ball 10. Whereas approximately ten to fifteen percent of the mass of a conventional sport ball may be from the seams between panels, welding panels 21 may reduce the mass at seams 22. By eliminating stitched seams in casing 20, the mass that would otherwise be imparted by the stitched seams may be utilized for other structural elements that enhance the performance properties (e.g., energy return, sphericity, mass distribution, durability, aerodynamics) of sport ball 10. Another advantage relates to manufacturing efficiency. Stitching each of the seams of a conventional sport ball is a relatively time-consuming process, particularly when hand stitching is utilized. By welding panels 21 together at seams 22, the time necessary for forming casing 20 may be deceased, thereby increasing the overall manufacturing efficiency.

Intermediate layer 30 is positioned between casing 20 and bladder 40 and may be formed to include one or more of a compressible foam layer that provides a softened feel to the sport ball, a rubber layer that imparts energy return, and a restriction layer to restrict expansion of bladder 40. The overall structure of intermediate layer 30 may vary significantly. As an example, the restriction layer may be formed from (a) a thread, yarn, or filament that is repeatedly wound around bladder 40 in various directions to form a mesh that covers substantially all of bladder 40, (b) a plurality of generally flat or planar textile elements stitched together to form a structure that extends around bladder 40, or (c) a plurality of generally flat or planar textile strips that are impregnated with latex and placed in an overlapping configuration around bladder 40. The restriction layer may also be a substantially seamless spherically-shaped textile, as disclosed in White et al., U.S. Pat. No. 8,192,311, issued Jun. 5, 2012. In some configurations of sport ball 10, intermediate layer 30 or portions of intermediate layer 30 may also be bonded, joined, or otherwise incorporated into casing 20 as a backing material, or intermediate layer 30 may be absent from sport ball 10. Accordingly, the structure of intermediate layer 30 may vary significantly to include a variety of configurations and materials.

Bladder 40 has an inflatable configuration and is located within intermediate layer 30 to provide an inner portion of sport ball 10. When inflated, bladder 40 exhibits a rounded or generally spherical shape. In order to facilitate inflation, bladder 40 may include a valved opening (not depicted) that extends through intermediate layer 30 and casing 20, thereby being accessible from an exterior of sport ball 10, or bladder 40 may have a valveless structure that is semi-permanently inflated. Bladder 40 may be formed from a rubber or carbon latex material that substantially prevents air or other fluids within bladder 40 from diffusing to the exterior of sport ball 10. In addition to rubber and carbon latex, a variety of other elastomeric or otherwise stretchable materials may be utilized for bladder 40. In some configurations, bladder 40 may also have a structure formed from a plurality of joined panels, as disclosed in U.S. patent application Ser. No. 12/147,943, filed in the U.S. Patent and Trademark Office on 27 Jun. 2008.

First Manufacturing Process

Figure 4:
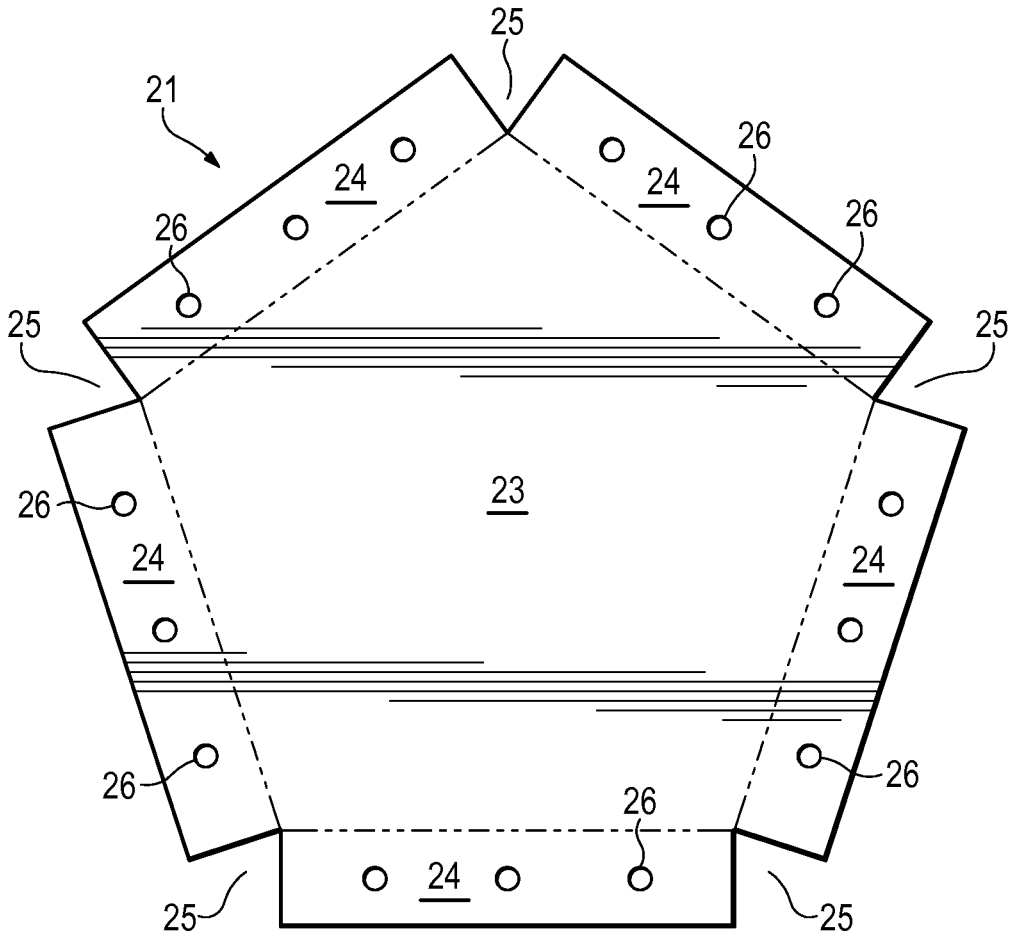
FIG. 4 is a top plan view of a panel of the sport ball.

The panels of conventional sport balls, as discussed above, may be joined with stitching (e.g., hand or machine stitching). Panels 21 are, however, at least partially formed from a polymer material, which may be a thermoplastic polymer material, that can be joined through the welding process. Referring to FIG. 4, one of panels 21 prior to incorporation into sport ball 10 is depicted as having a panel area 23 and five flange areas 24. Whereas panel area 23 generally forms a central portion of panel 21, flange areas 24 generally form edge portions of panel 21 and extend around panel area 23. For purposes of reference, dashed lines are depicted as extending between panel area 23 and the various flange areas 24. Panel 21 has a pentagonal shape and each of flange areas 24 correspond with one side region of the pentagonal shape. In further configurations where a panel has a different shape, the number of flange areas may change to correspond with the number of sides of the shape. Panel 21 defines five notches 25 that extend inward from vertices of the pentagonal shape and effectively separate the various flange areas 24 from each other. Notches 25 may, therefore, permit flange areas 24 to flex or otherwise move independent of each other, although flange areas 24 remain connected to panel area 23. Additionally, each flange area 24 defines various registration apertures 26 that form holes extending through panel 21.

Figures 5, 6:
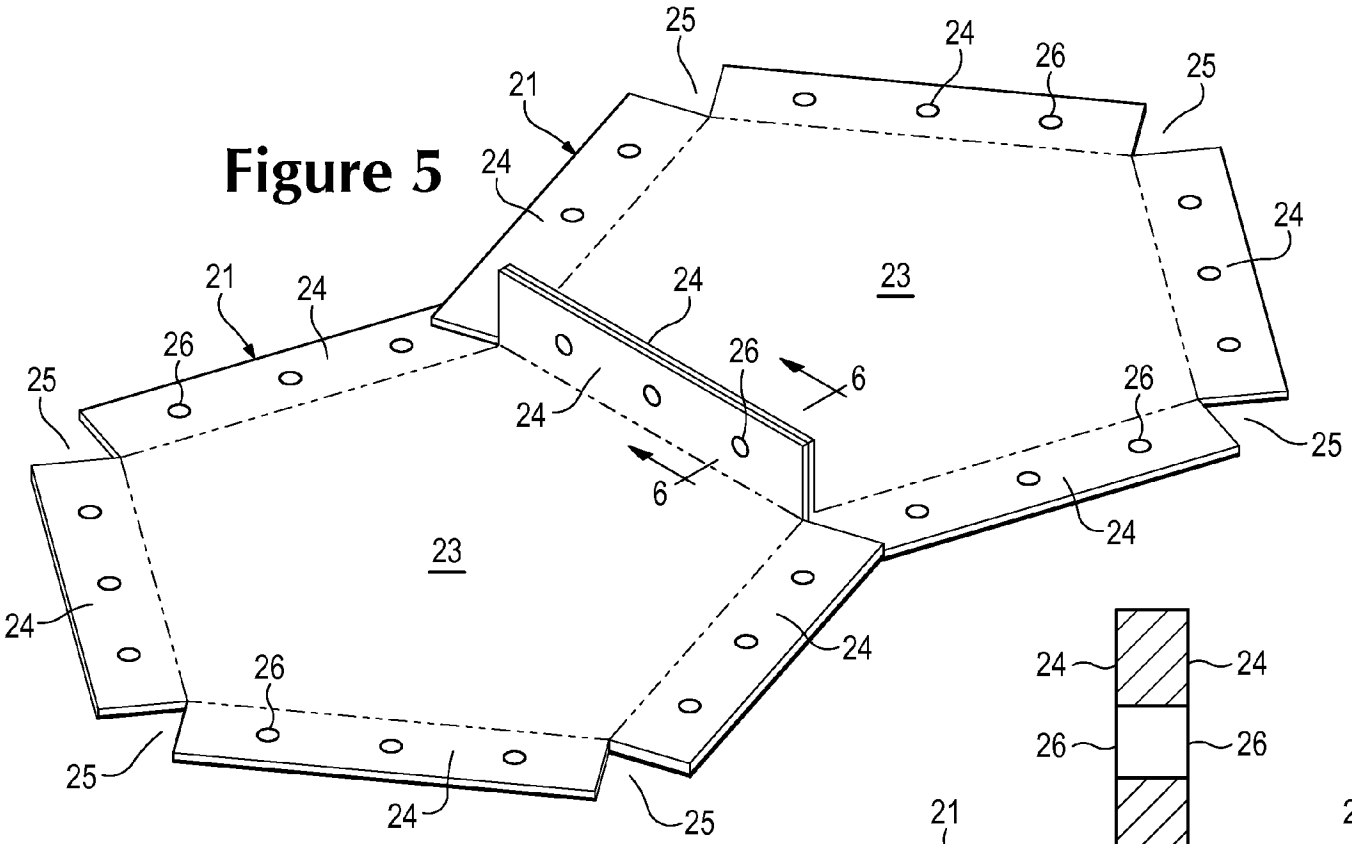
FIG. 5 is a perspective view of two joined panels.
FIG. 6 is a cross-sectional view of the joined panels, as defined by section line 6-6 in FIG. 5.

Panel areas 23 of the various panels 21 form a majority or all of the portion of casing 20 that is visible on the exterior of sport ball 10. Flange areas 24, however, form portions of panels 21 that are bonded together to join panels 21 to each other. Referring to FIGS. 5 and 6, an example of the manner in which two panels 21 are joined to each other is depicted. Although panel areas 23 are generally co-planar with each other, the joined flange areas 24 bend upward and are joined along abutting surfaces. Additionally, registration apertures 26 from each of the joined flange areas 24 are aligned. By aligning registration apertures 26 prior to bonding (i.e., through welding), flange areas 24 are properly positioned relative to each other. As discussed in greater detail below, portions of the joined flange areas 24 may be trimmed during the manufacturing process for casing 20. Note that the upwardly-facing surfaces in FIGS. 5 and 6 are located on an interior of sport ball 10 once manufacturing is completed, and downwardly-facing surfaces form an exterior surface of sport ball 10.

Panels 21 are discussed above as including a polymer material, which may be utilized to secure panels 21 to each other. Examples of suitable polymer materials for panels 21 include thermoplastic and/or thermoset polyurethane, polyamide, polyester, polypropylene, and polyolefin. In some configurations, panels 21 may incorporate filaments or fibers that reinforce or strengthen casing 20. In further configurations, panels 21 may have a layered structure that includes an outer layer of the polymer material and an inner layer formed from a textile, polymer foam, or other material that is bonded with the polymer material. Panels 21 may also incorporate multiple joined layers formed from a variety of materials.

When exposed to sufficient heat, the polymer materials within panels 21 transition from a solid state to either a softened state or a liquid state, particularly when a thermoplastic polymer material is utilized. When sufficiently cooled, the polymer materials then transition back from the softened state or the liquid state to the solid state. Based upon these properties of polymer materials, welding processes may be utilized to form a weld that joins portions of panels 21 (i.e., flange areas 24) to each other. As utilized herein, the term "welding" or variants thereof is defined as a securing technique between two elements that involves a softening or melting of a polymer material within at least one of the elements such that the materials of the elements are secured to each other when cooled. Similarly, the term "weld" or variants thereof is defined as the bond, link, or structure that joins two elements through a process that involves a softening or melting of a polymer material within at least one of the elements such that the materials of the elements are secured to each other when cooled. As examples, welding may involve (a) the melting or softening of two panels 21 that include polymer materials such that the polymer materials from each panel 21 intermingle with each other (e.g., diffuse across a boundary layer between the polymer materials) and are secured together when cooled and (b) the melting or softening a polymer material in a first panel 21 such that the polymer material extends into or infiltrates the structure of a second panel 21 (e.g., infiltrates crevices or cavities formed in the second panel 21 or extends around or bonds with filaments or fibers in the second panel 21) to secure the panels 21 together when cooled. Welding may occur when only one panel 21 includes a polymer material or when both panels 21 include polymer materials. Additionally, welding does not generally involve the use of stitching or adhesives, but involves directly bonding panels 21 to each other with heat. In some situations, however, stitching or adhesives may be utilized to supplement the weld or the joining of panels 21 through welding.

Figure 7:
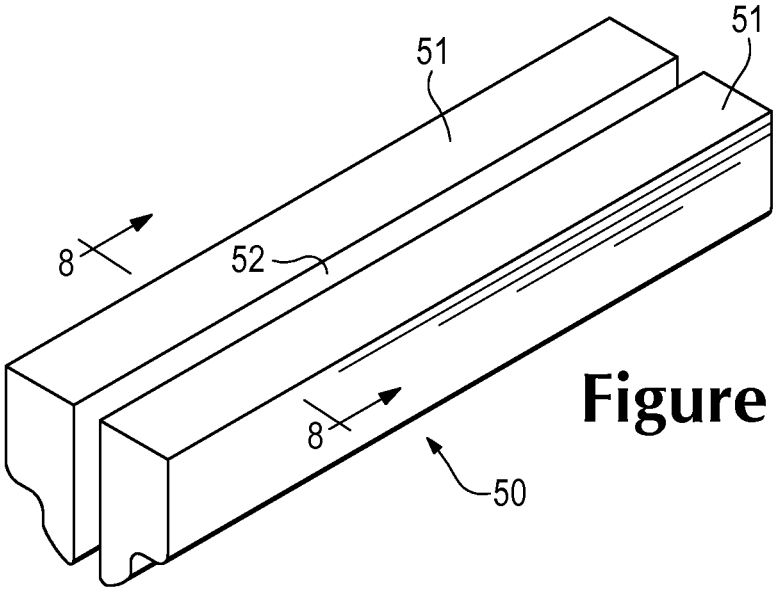
FIG. 7 is a perspective view of a welding tool utilized in joining the panels.
Figure 8:
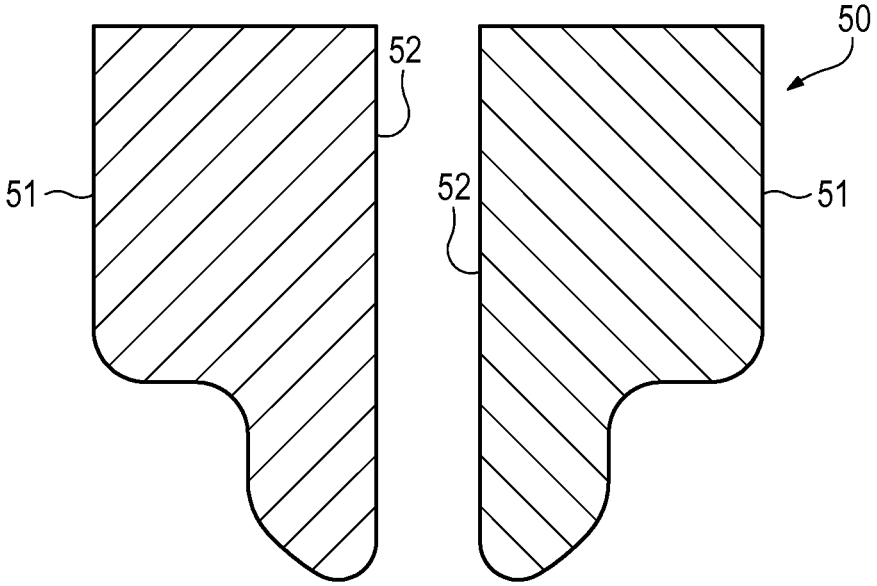
FIG. 8 is a cross-sectional view of the welding tool, as defined by section line 8-8 in FIG. 7.

A variety of techniques may be utilized to weld flange areas 24 to each other, including conduction heating, radiant heating, radio frequency heating, ultrasonic heating, and laser heating. An example of a welding die 30 that may be utilized to form seams 22 by bonding two flange areas 24 is depicted in FIGS. 7 and 8. Welding die 50 includes two portions 51 that generally correspond in length with a length of one of the sides of panels 21. That is, the length of welding die 50 is generally as long as or longer than the lengths of flange areas 24. Each portion 51 also defines a facing surface 52 that faces the other portion 51. That is, facing surfaces 52 face each other. If utilized for purposes of conduction heating, for example, portions 51 may each include internal heating elements or conduits that channel a heated liquid in order to sufficiently raise the temperature of welding die 50 to form a weld between flange areas 24. If utilized for purposes of radio frequency heating, one or both of portions 51 may emit radio frequency energy that heats the particular polymer material within panels 21. In addition to welding die 50, a variety of other apparatuses that may effectively form a weld between panels 21 may be utilized.

Figure 9A:
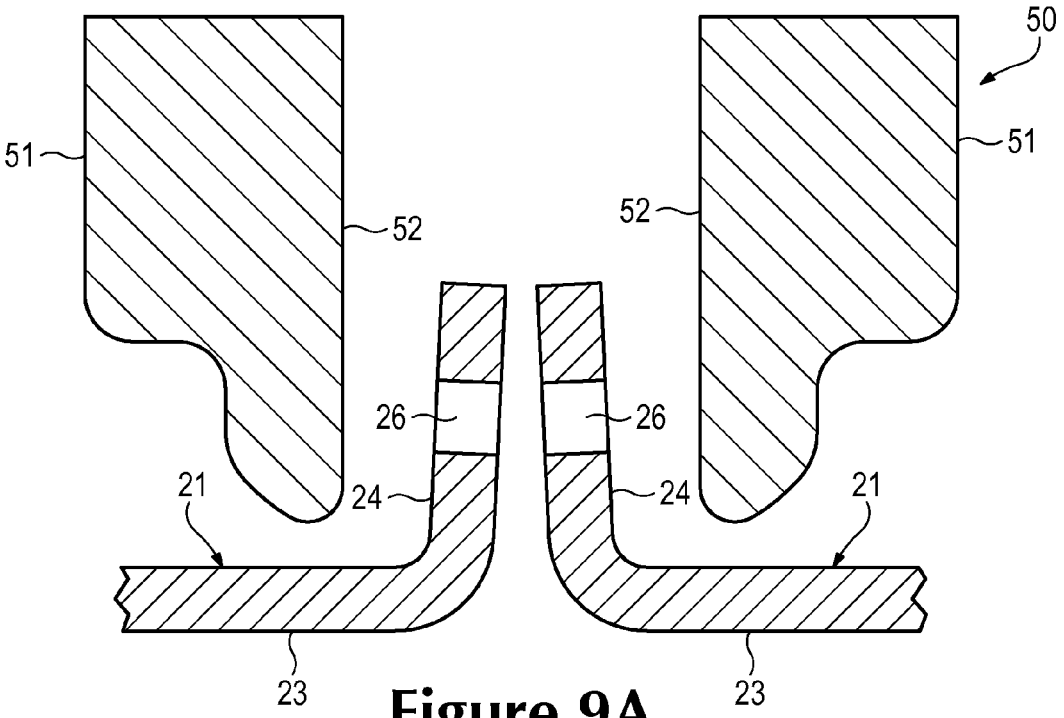
FIGS. 9A-9E are schematic cross-sectional views depicting steps of welding the panels together in a manufacturing process for the sport ball.
Figure 9B:
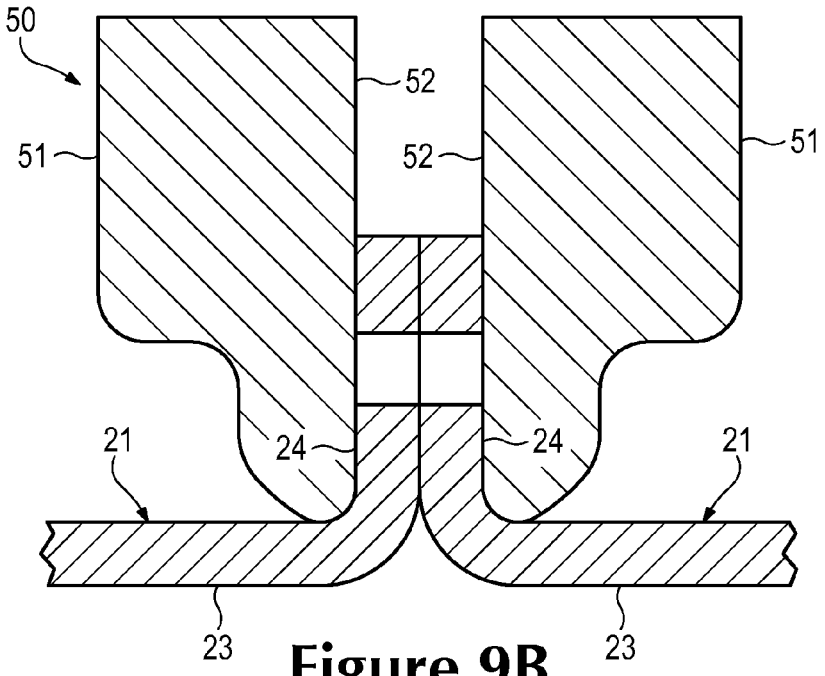
Figure 9C:
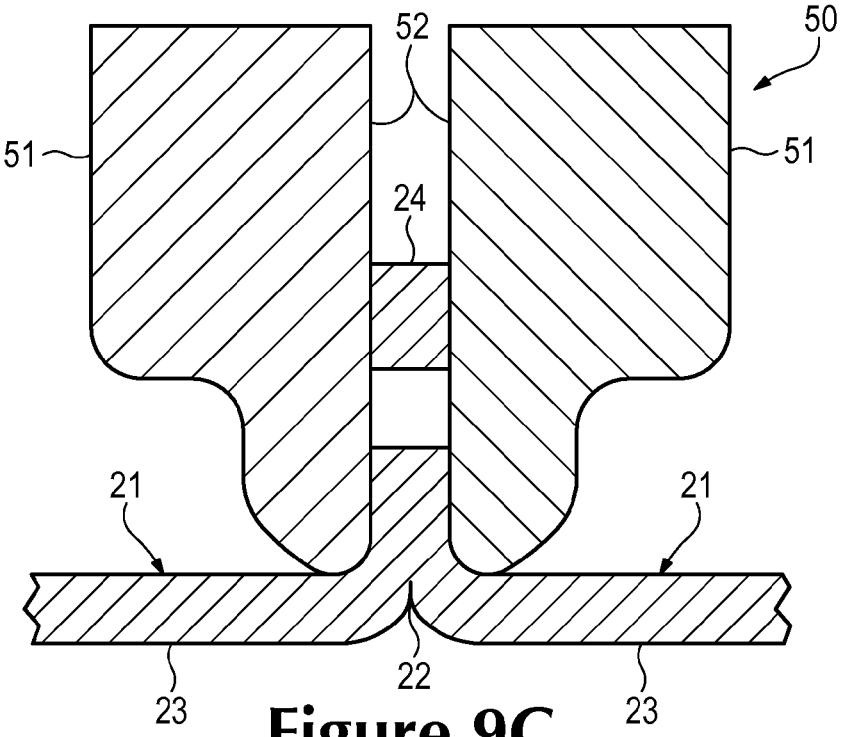
Figure 9D:
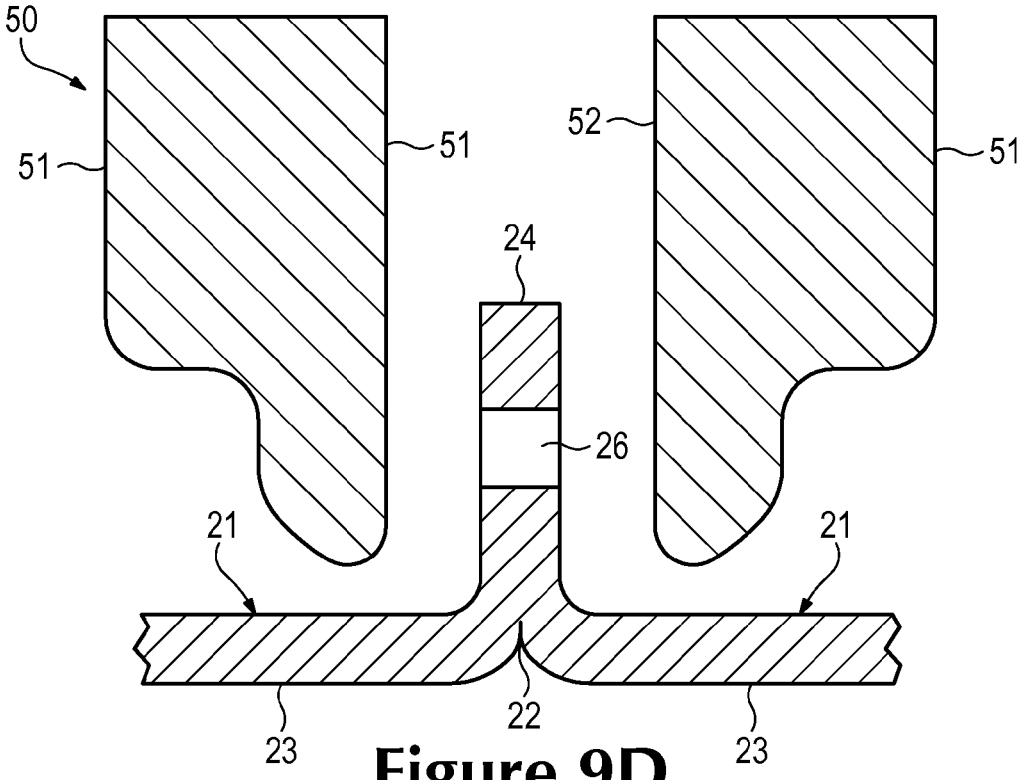
Figure 9E:
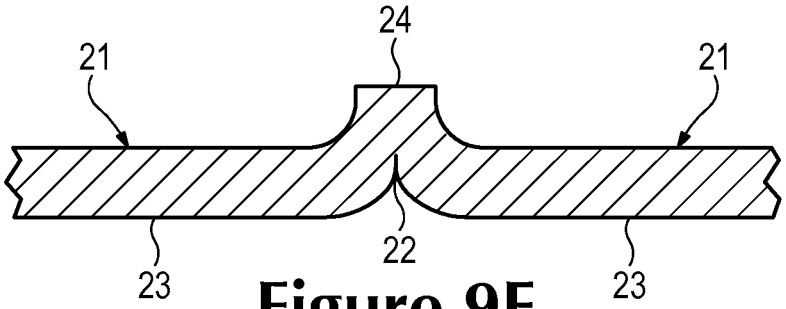

A general process for joining panels 21 with welding die 50 will now be discussed with reference to FIGS. 9A-9E. Initially, adjacent flange areas 24 from two panels 21 are located such that (a) surfaces of the flange areas 24 face each other and (b) registration apertures 26 are generally aligned, as depicted in FIG. 9A. Portions 51 of welding die 50 are also located on opposite sides of the abutting flange areas 24. Portions 51 then compress flange areas 24 together between facing surfaces 52 to cause surfaces of flange areas 24 to contact each other, as depicted in FIG. 9B. By heating flange areas 24 with welding die 50, the polymer materials within flange areas 24 melt or otherwise soften to a degree that facilitates welding between flange areas 24, as depicted in FIG. 9C, thereby forming seam 22 between panels 21. Once seam 22 is formed by bonding flange areas 24 together, portions 51 may retract from flange areas 24, as depicted in FIG. 9D. Excess portions of flange areas 24, which may include portions that define registration apertures 26, are then trimmed or otherwise removed to complete the formation of one of seams 22, as depicted in FIG. 9E.

Figure 10:
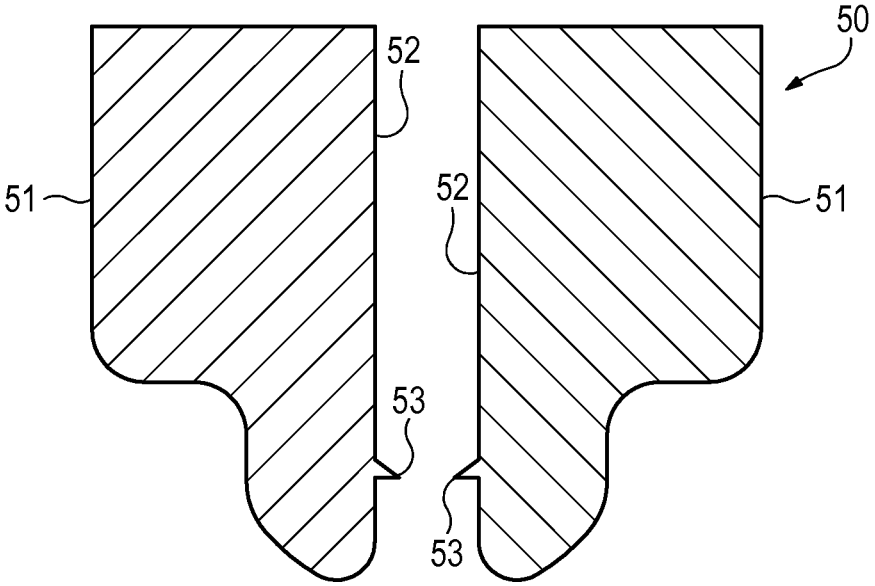
FIG. 10 is a cross-sectional view that corresponds with FIG. 8 and depicts another configuration of the welding tool.

A variety of trimming processes may be utilized to remove the excess portions of flange areas 24. As examples, the trimming processes may include the use of a cutting apparatus, a grinding wheel, or an etching process. As another example, welding die 50 may incorporate cutting edges 53, as depicted in FIG. 10, that trim flange areas 24 during the welding process. That is, cutting edges 53 may be utilized to protrude through flange areas 24 and effectively trim flange areas 24 as portions 51 heat and compress flange areas 24 together between facing surfaces 52.

Figure 11A:
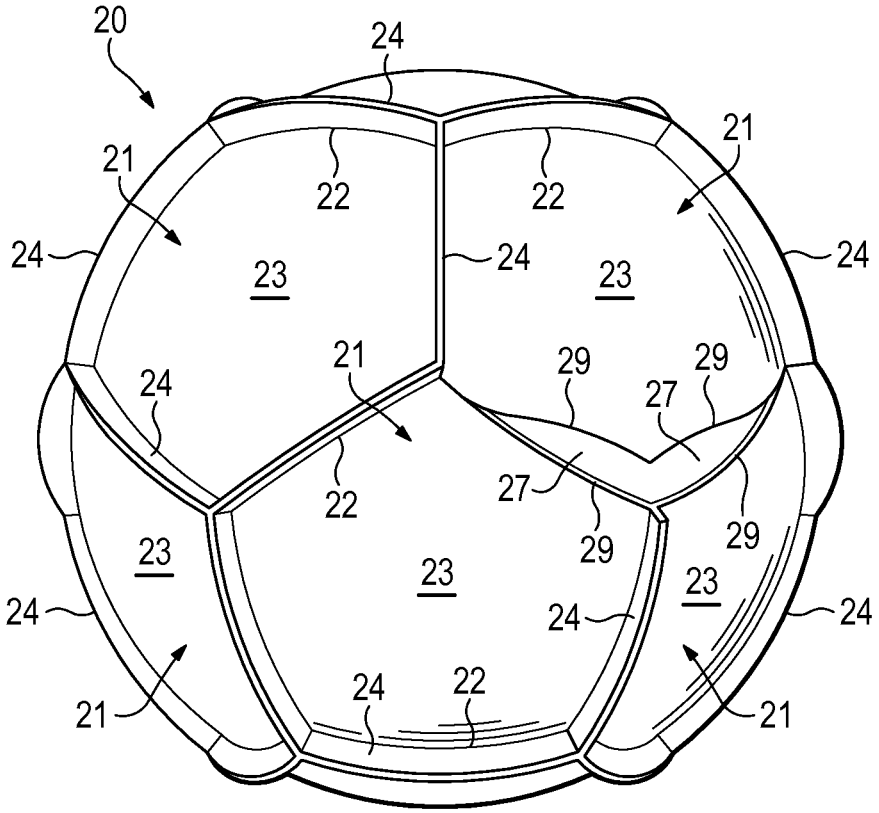
FIGS. 11A-11F are perspective views depicting further steps in the manufacturing process for the sport ball.
Figure 11B:
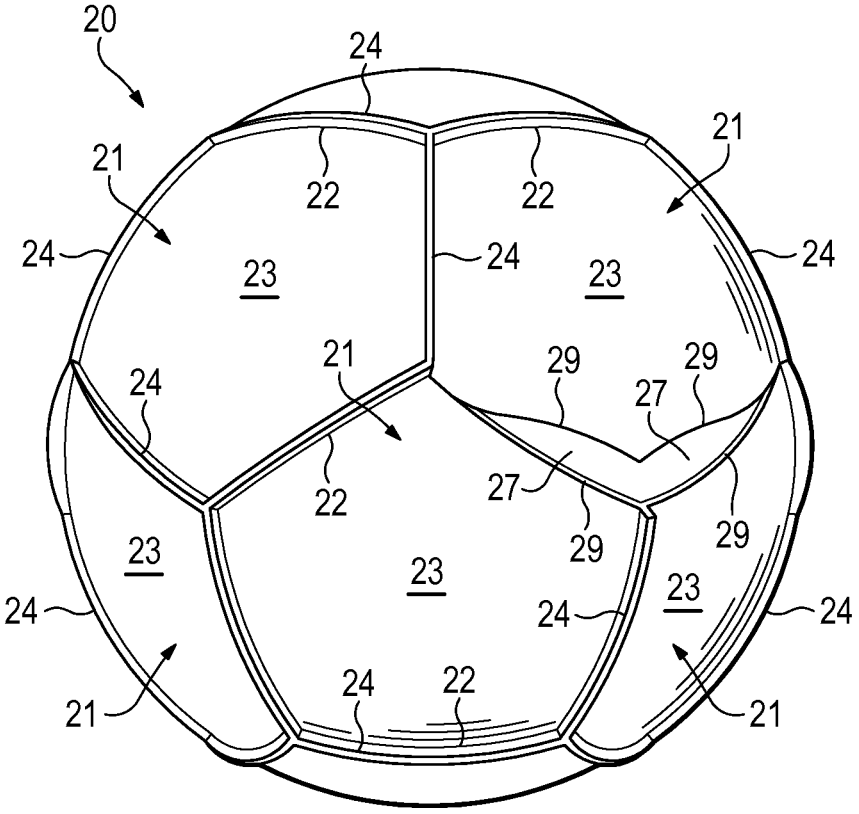

The general process of welding flange areas 24 to form seams 22 between panels 21 was generally discussed above relative to FIGS. 9A-9E. This general process may be repeatedly performed with multiple panels 21 and on multiple flange areas 24 of each panel 21 to effectively form a generally spherical or closed structure, as depicted in FIG. 11A. That is, multiple panels 21 may be welded together through the general process discussed above in order to form various seams 22 in casing 20. A similar configuration is depicted in FIG. 11B, wherein flange areas 24 are trimmed. As discussed above, the trimming or removal of flange areas 24 may occur following the welding process or may occur at the time of the welding process.

Figure 11C:
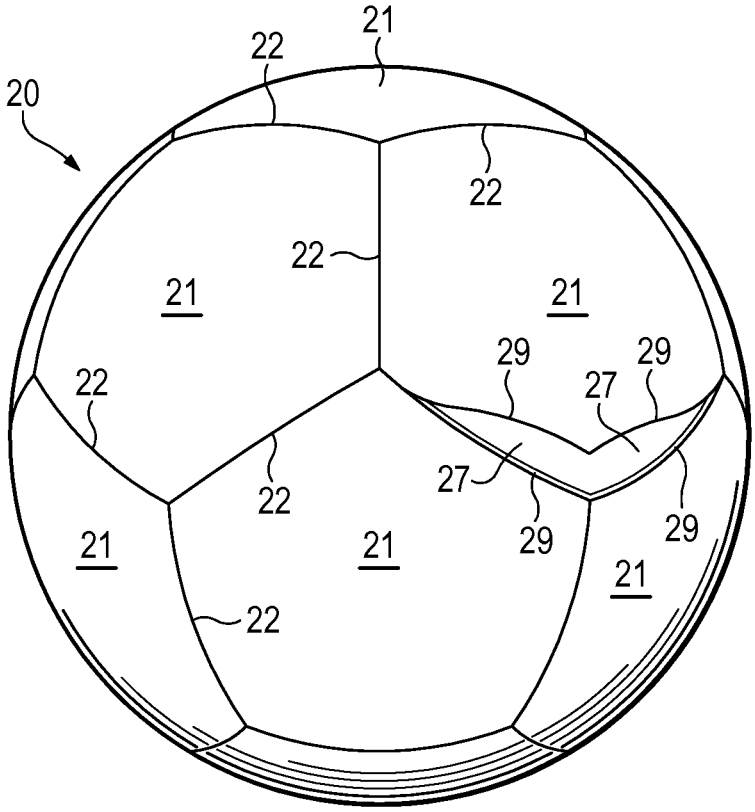

Although seams 22 are generally formed between each of flange areas 24, one or more seams 22 may remain unformed at this stage of the process. Referring to FIGS. 11A and 11B, two unbonded areas 27 are located adjacent to each other and form an opening in casing 20. One purpose of unbonded areas 27 is that casing 20 may be turned inside-out or otherwise reversed through the opening or aperture formed by unbonded areas 27. More particularly, unbonded areas 27 may be separated to form the opening, as depicted in FIG. 11B, and casing 20 may be reversed or turned inside-out through that opening to impart the configuration depicted in FIG. 11C. Whereas the trimmed portions of flange areas 24 protrude outward in FIG. 11B, reversing or turning casing 20 inside-out through the opening from unbonded areas 27 places all of flange areas 24 within casing 20. Accordingly, the trimmed flange areas 24 protrude inward, rather than outward, once casing 20 is reversed or turned inside-out. Referring to FIG. 3, for example, an exterior of casing 20 has a generally smooth configuration, while portions of casing 20 corresponding with flange areas 24 protrude inward. Although panels 21 form an indentation on the exterior of sport ball 10 in the areas of seams 22, similar indentations are commonly found in game balls with stitched seams.

Figure 12:
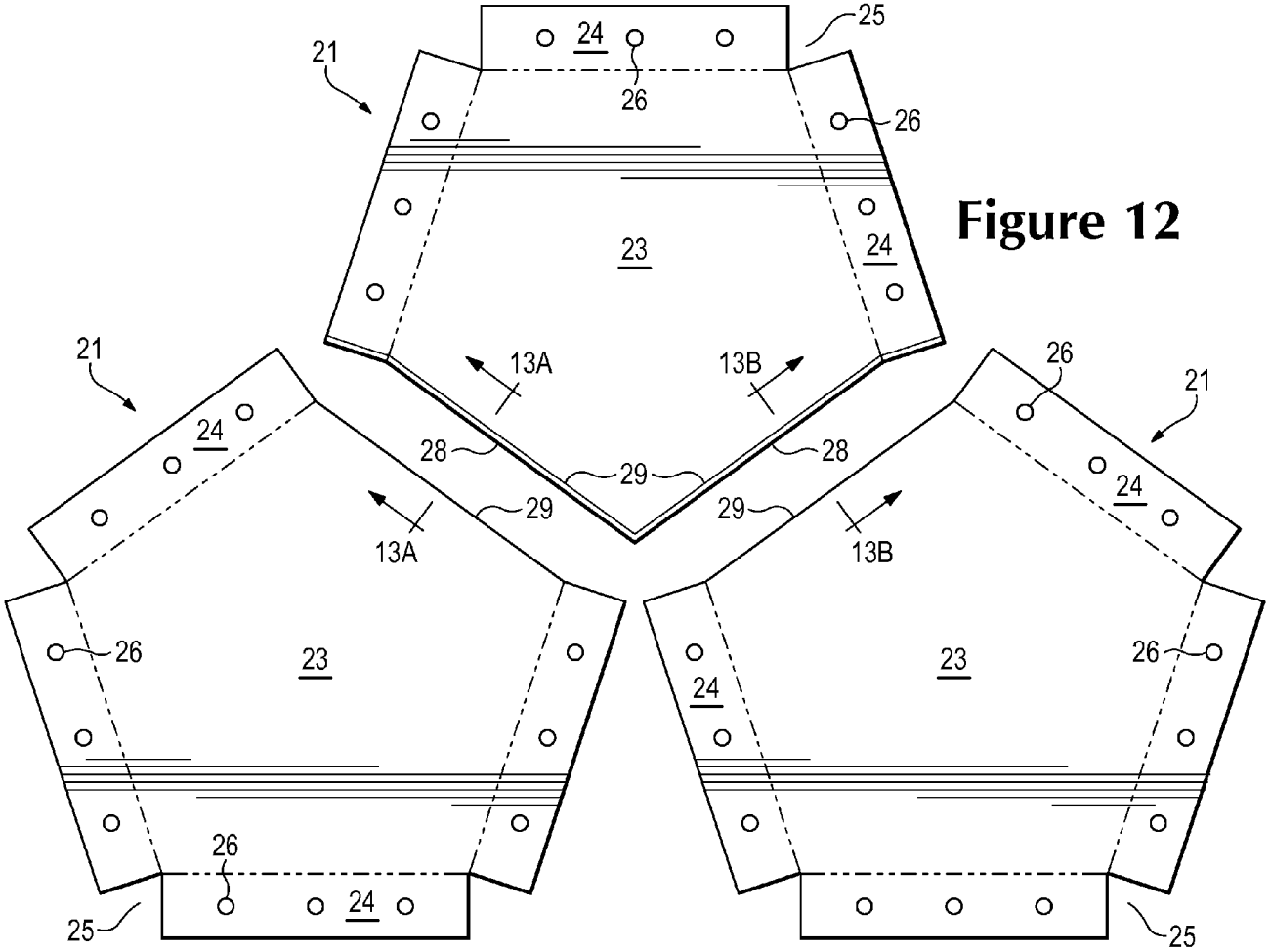
FIG. 12 is a top plan view of three panels of the sport ball.

A further consideration at this stage of the manufacturing process relates to the configurations of panels 21 that form unbonded areas 27. Referring to FIG. 4, this panel 21 includes five flange areas 24 that extend around edges of the pentagonal panel area 23, and a majority of panels 21 exhibit this configuration. In panels 21 that form unbonded areas 27, which are collectively depicted in FIG. 12, various flange areas 24 are absent. Additionally, as depicted in the cross-sections of FIGS. 13A and 13B, two edges 29 where flange areas 24 are absent may be molded or otherwise shaped. Although unbonded areas 27 are formed between two sets of adjacent edges 29, a single unbonded area may be formed between only two edges 29. Accordingly, the opening formed by unbonded areas 27 is formed between edges 29 of at least two panels 21, but may be formed between four or more edges 29.

Figure 11D:
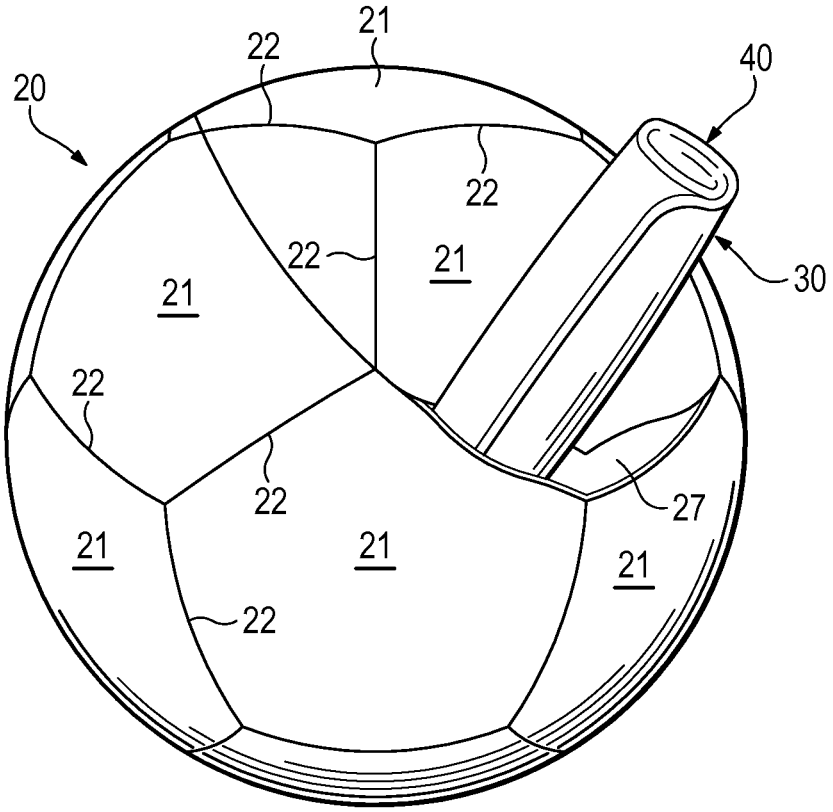
Figure 11E:
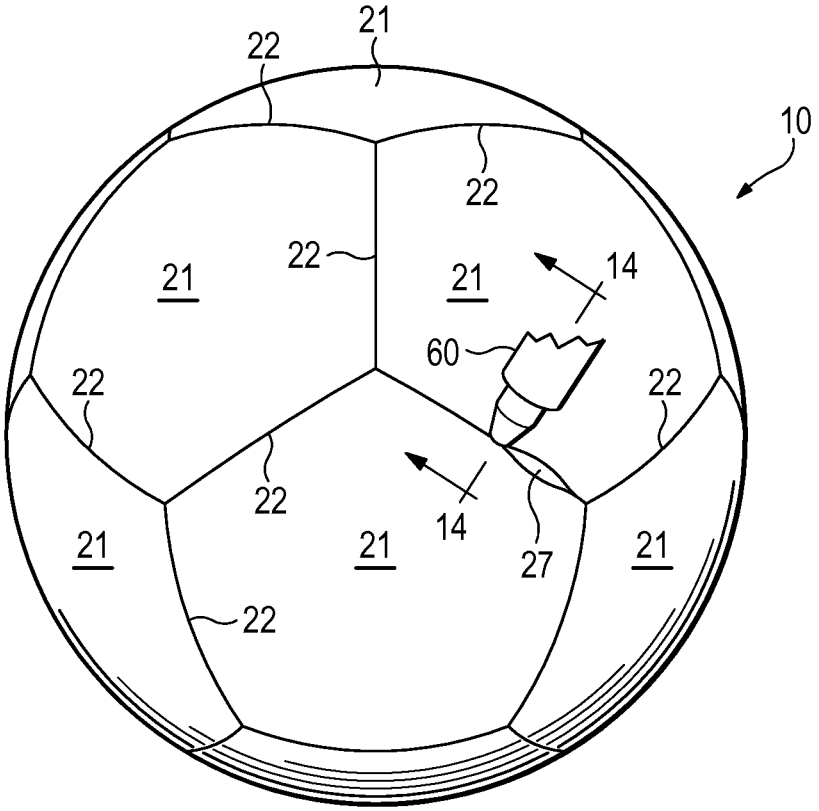
Figure 11F:
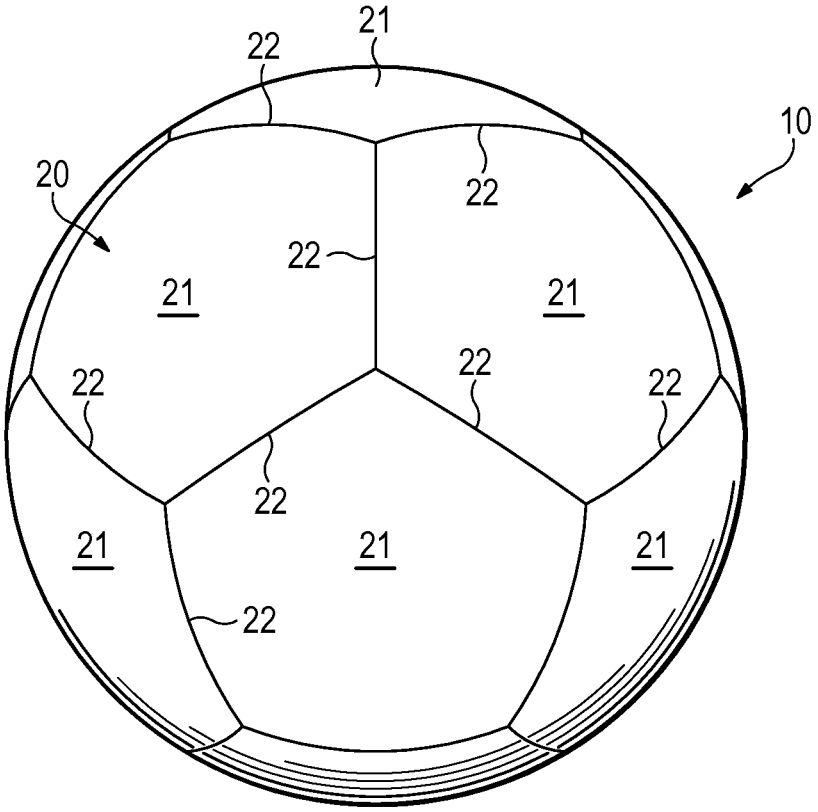

At this stage of the manufacturing process, casing 20 is substantially formed and the surfaces of casing 20 are correctly oriented. The opening in casing 20 formed by unbonded areas 27 may now be utilized to insert intermediate layer 30 and bladder 40, as depicted in FIG. 11D. That is, intermediate layer 30 and bladder 40 may be located within casing 20 through the opening that was utilized to reverse or turn casing 20 inside-out. Intermediate layer 30 and bladder 40 are then properly positioned within casing 20, which may include partially inflating bladder 40 to induce contact between surfaces of intermediate layer 30 and casing 20. Additionally, the valved opening (not depicted) of bladder 40 may be located to extend through intermediate layer 30 and casing 20, thereby being accessible from an exterior of sport ball 10. Once intermediate layer 30 and bladder 40 are properly positioned within casing 20, the opening in casing 20 formed between unbonded flange areas 24 may be sealed, as depicted in FIG. 11E. More particularly, a sealing die 60 may form a weld between the unbonded flange areas 24 (i.e., in unbonded areas 27) to form a final seam 22 that effectively closes casing 20, thereby substantially completing the manufacturing process of sport ball 10, as depicted in FIG. 11F. As an alternative to welding, stitching or adhesives may be utilized to close casing 20.

Figure 14A:
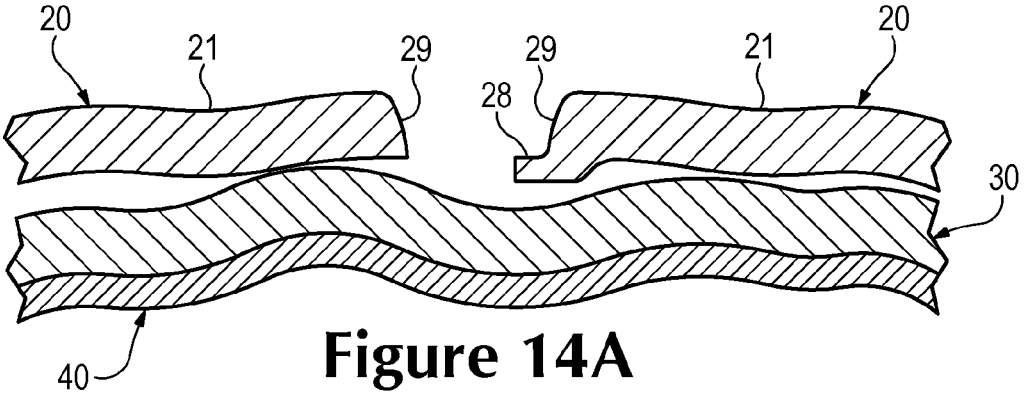
FIGS. 14A-14E are cross-sectional views depicting additional steps in the manufacturing process for the sport ball, as defined by a section line 14-14 in FIG. 11E.
Figure 14B:
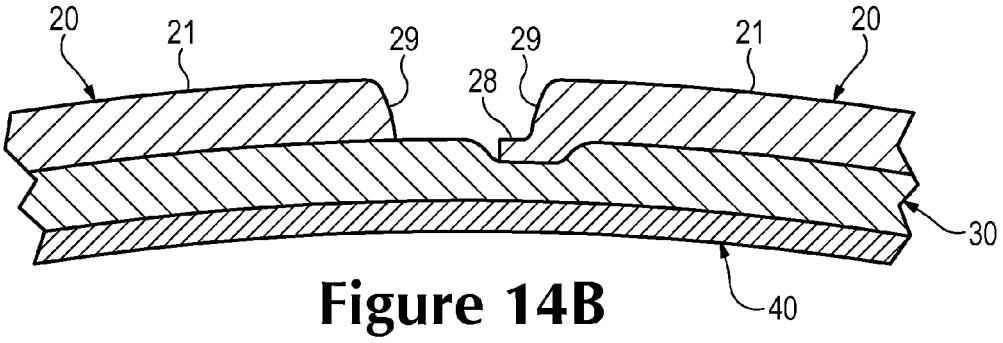

The manner in which seams 22 are formed at unbonded areas 27 will now be discussed in greater detail. Referring to FIG. 11E, a cross-section line 14-14 is defined as extending through the area of sport ball 10 where sealing die 60 is joining two panels 21 to form seams 22. The overall process for joining the panels 21 at unbonded areas 27 is discussed in relation to cross-section line 14-14 in FIGS. 14A-14E. Referring to FIG. 14A, panels 21 of casing 20 rest loosely against the combination of intermediate layer 30 and bladder 40, both of which were recently inserted into the interior of casing 20. Bladder 40 is then inflated, as depicted in FIG. 14B, which imparts a firm and rounded configuration to the combination of intermediate layer 30 and bladder 40. Moreover, intermediate layer 30 presses outward upon casing 20 and lays adjacent to an interior surface of casing 20, thereby imparting a generally spherical aspect to sport ball 10.

As noted above and depicted in the cross-sections of FIGS. 13A and 13B, edges 29 where flange areas 24 are absent may be molded or otherwise shaped. More particularly, both of edges 29 are shaped to have a radius or generally rounded configuration. That is, edges 29 have curved configurations extending from an outer surface to an inner surface of casing 20, thereby extending toward and interior of sport ball 10. Additionally, one of edges 29 also defines a projection 28. Referring to FIG. 14C, projection 28 extends outward and under the other edge 29, thereby being positioned between the other edge 29 and both of intermediate layer 30 and bladder 40. At this stage, sealing die 60 is positioned adjacent to the two edges 29. Sealing die 60 then presses downward on edges 29 and heats the material of panels 21 at edges 29 to weld edges 29 together, including bonding projection 28 to the other edge 29, as depicted in FIG. 14D. Sealing die 60 then retracts once a seam 22 is formed between the two panels 21, as depicted in FIG. 14E. Moreover, the seam 22 has the general appearance of other seams 22 (see FIG. 3) due to the radius or generally rounded configuration. Aesthetically, therefore, the seam 22 formed between unbonded areas 27 appears similar or even identical to other seams 22 in sport ball 10.

Figure 13A:
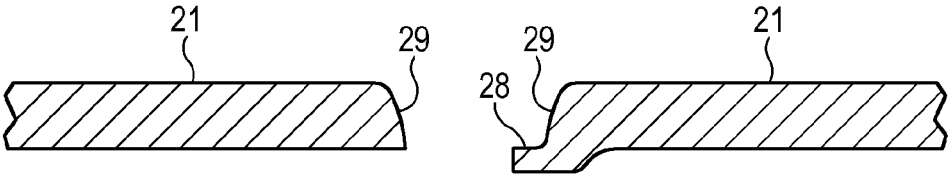
FIGS. 13A and 13B are cross-sectional views of the panels, as defined by section lines 13A-13A and 13B-13B in FIG. 12.
Figure 13B:
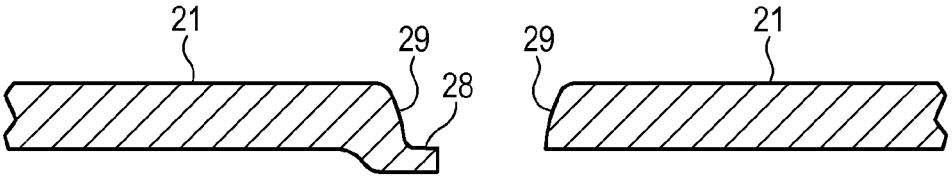
Figure 14C:
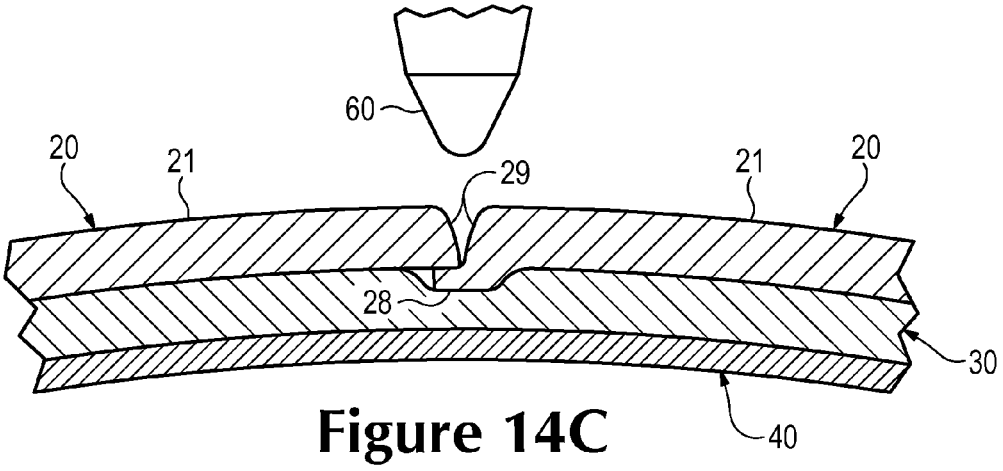
Figure 14D:
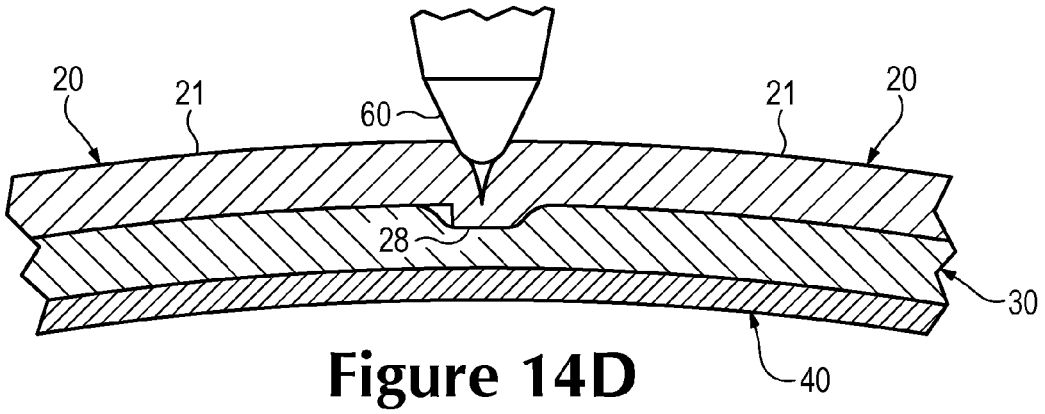
Figure 14E:
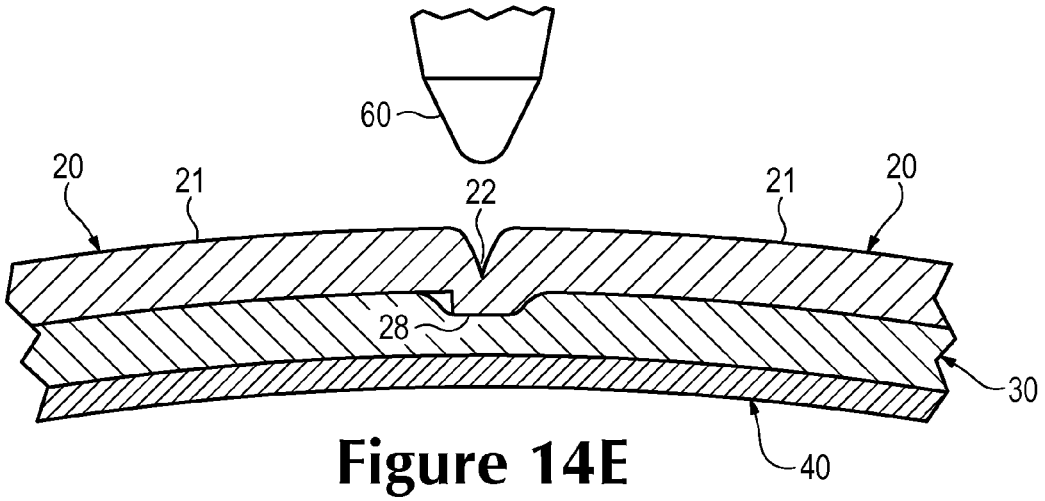
Figure 15A:
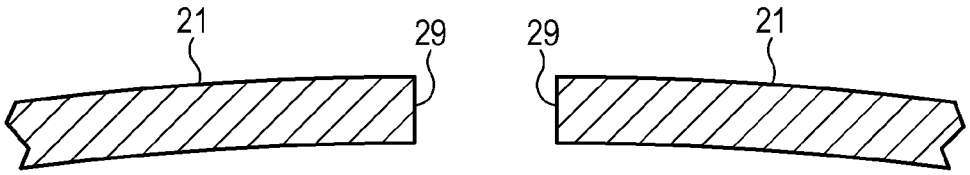
FIGS. 15A-15F are cross-sectional views corresponding with FIG. 13A and depicting further configurations of the panels.
Figure 15B:
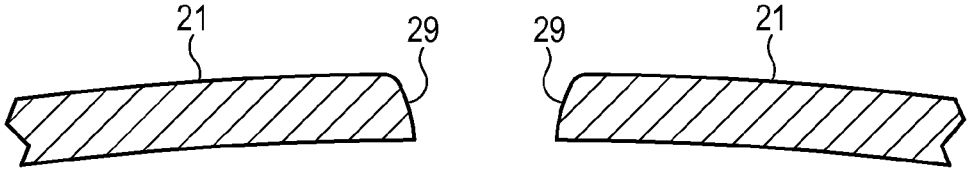
Figure 15C:
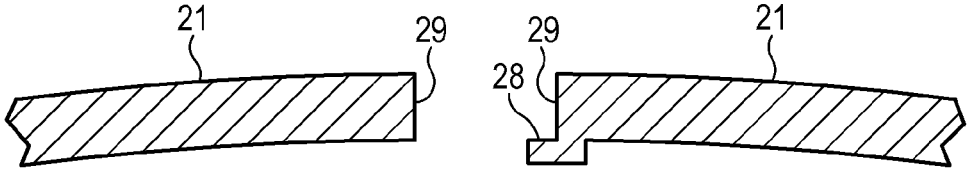
Figure 15D:
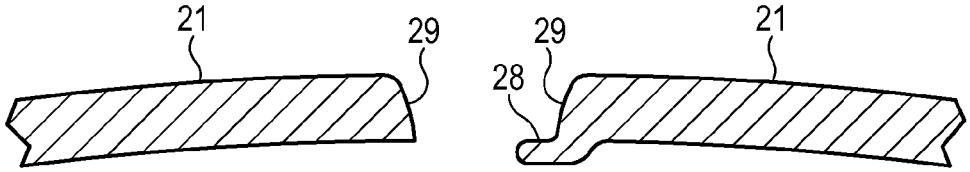
Figure 15E:
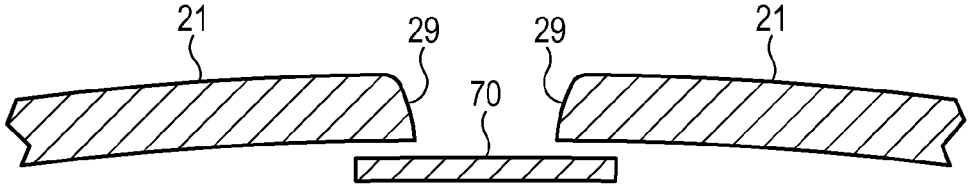
Figure 15F:
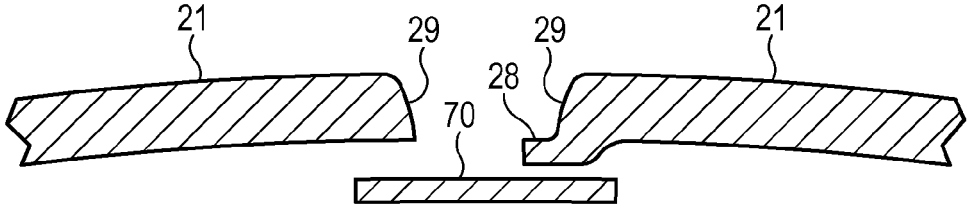
Figure 16A:
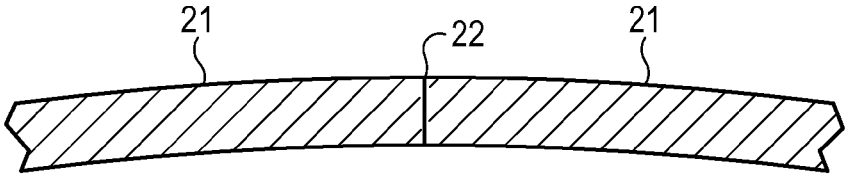
FIGS. 16A-16F are cross-sectional respectively depicting the panels from FIGS. 15A-15E as being joined.
Figure 16B:
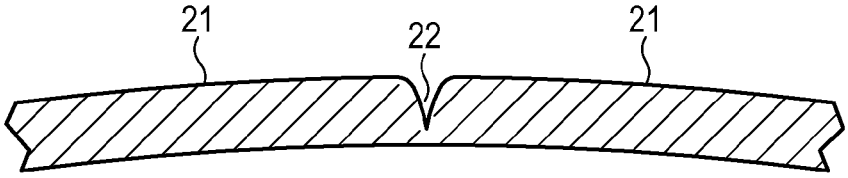
Figure 16C:
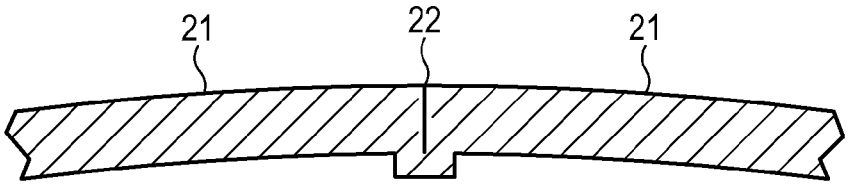
Figure 16D:
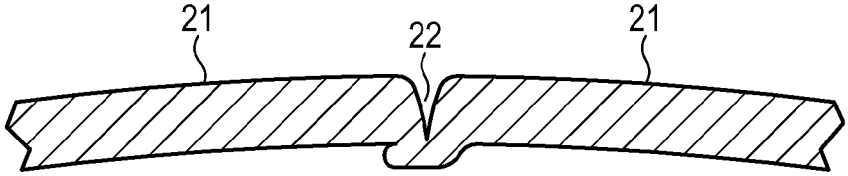
Figure 16E:
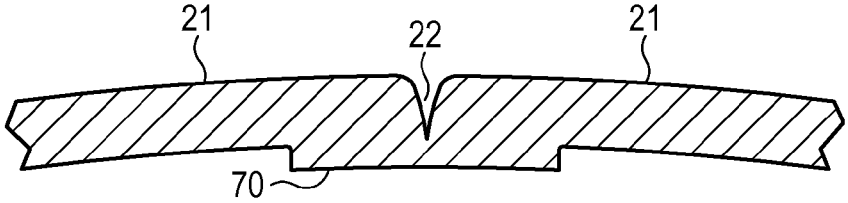
Figure 16F:
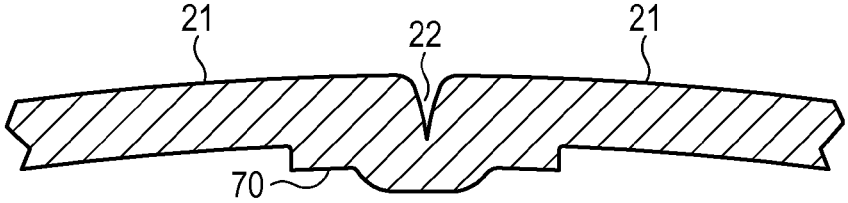

Molding or shaping the edges where flange areas 24 are absent, as in FIGS. 13A and 13B, imparts two advantages to sport ball 10. First, projection 28 forms a flange that assist in forming and strengthening the weld between the two panels 21. Second, the radius or rounded configuration of edges 29 imparts the general appearance of other seams 22 in sport ball 10. Although projection 28 and the rounded configuration of edges 29 may be utilized in sport ball 10, a variety of other configurations may also be utilized. As an example, FIG. 15A depicts a configuration wherein edges 29 have squared configurations, and FIG. 16A depicts these squared edges 29 as being joined. In this configuration, seam 22 may exhibit a smooth rather than indented aspect. Edges 29 may also have a rounded configuration wherein projection 28 is absent, as depicted in FIGS. 15B and 16B. In another configuration, projection 28 may be present, but edges 29 may have the squared configuration, as depicted in FIGS. 15C and 16C. A length of projection 28 may also vary. Referring to FIGS. 15D and 16D, for example, projection 28 exhibits greater length than in other configurations. As a further example, a supplemental layer 70 may be utilized to assist in bonding panels 21 together. Although the configuration may vary, supplemental layer 70 may incorporate a thermoplastic polymer material that becomes welded to panels 21. Referring to FIG. 15E supplemental layer 70 is located below panels 21 and extends across the gap formed by edges 29. Upon welding, as depicted in FIG. 16E, each of panels 21 are joined to supplemental layer 70, and edges 29 may also be joined to each other. Supplemental layer 70 may also be utilized with any of the configurations discussed above to further strengthen seam 22 or otherwise assist with the welding process. Referring to FIGS. 15F and 16F, for example, supplemental layer 70 is utilized with a configuration wherein edges 29 are rounded and one of edges 29 defines projection 28. Accordingly, the configuration of panels 21 at edges 29 may vary considerably to impart a variety of configurations to the seam 22 utilized to close sport ball 10.

Based upon the above discussion, casing 20 of sport ball 10 may be formed by joining the various panels 21 at seams 22 with a first welding operation (i.e., with welding die 50). In order to place protruding portions of flange areas 24 within sport ball 10, casing 20 may be effectively reversed or otherwise turned inside-out through an opening in casing 20. Once intermediate layer 30 and bladder 40 are positioned within casing 20, the opening may be sealed with a second welding operation (i.e., with sealing die 60). Two different welding operations utilizing two different welding apparatuses are, therefore, utilized to join panels 21 and form casing 20. Moreover, the first welding operation forms a majority of seams 22, while the second welding operation forms the final few seams 22. Additionally, edges 29 may be molded or otherwise formed to have a structure that effectively welds together. As an example, both edges 29 may be molded or shaped to have a radius or generally rounded configuration, and one of edges 29 also defines a projection 28.

Second Manufacturing Process

Figure 17:
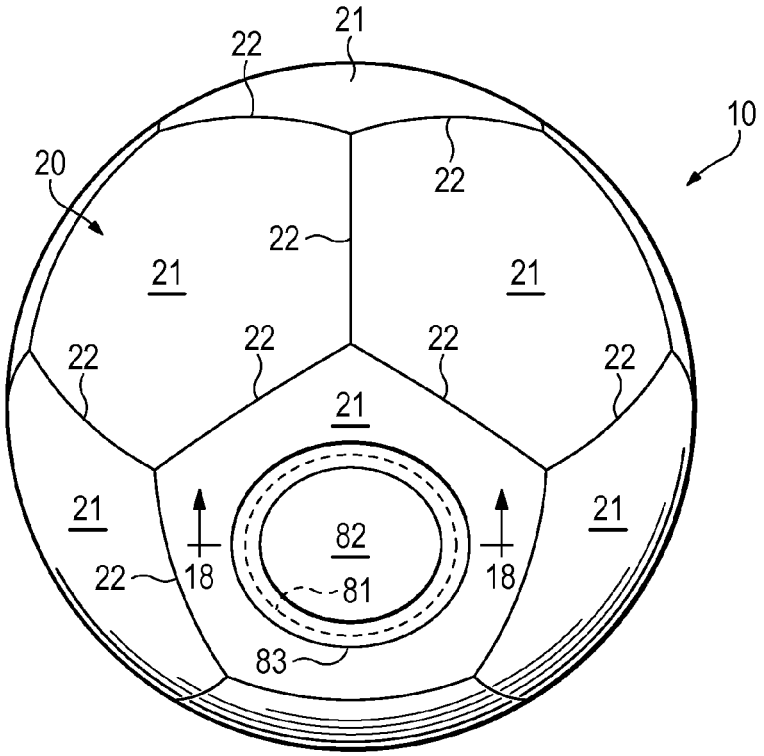
FIG. 17 is a perspective view of another configuration of the sport ball.
Figure 18:
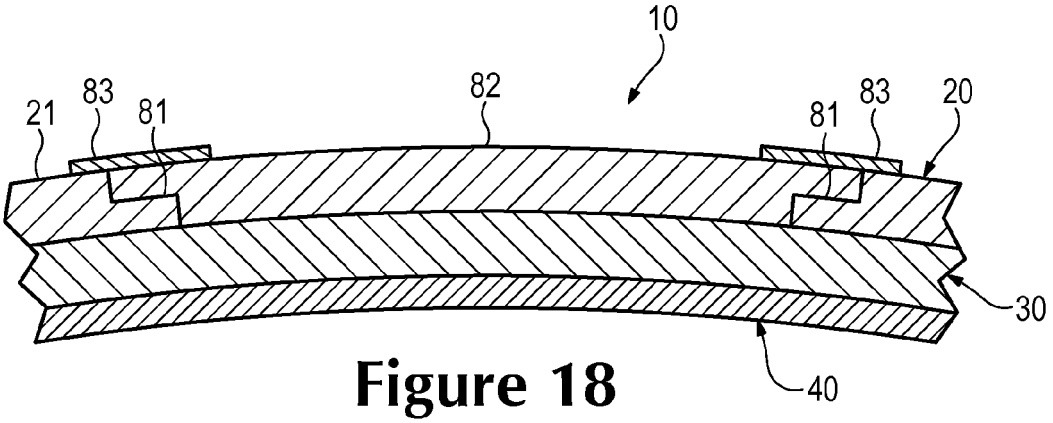
FIG. 18 is a cross-sectional view of a portion of the sport ball depicted in FIG. 17, as defined by section line 18-18 in FIG. 17.

An opening in casing 20 formed between unbonded flange areas 24 (i.e., in unbonded areas 27) is one example of a structure that may be utilized to (a) reverse or turn casing 20 inside-out to place protruding flange areas 24 within casing 20 and (b) insert intermediate layer 30 and bladder 40 within casing 20. As another example, one of panels 21 may define an aperture 81 that is sealed with a plug 82 and covered with a cover layer 83, as depicted in FIGS. 17 and 18. More particularly, aperture 81 may be utilized to (a) reverse or turn casing 20 inside-out to place protruding flange areas 24 within casing 20 and (b) insert intermediate layer 30 and bladder 40 within casing 20. Once these steps are complete, plug 82 is located within aperture 81 and welded or otherwise joined to the panel 21 defining aperture 81. Although sealing die 40 or a similar apparatus may be utilized to weld plug 82 to casing 20, stitching or adhesives may also be utilized to close casing 20. Once welding is complete, cover layer 83 may be bonded, welded, adhered, or otherwise joined to casing 20 to cover the weld between plug 82 and the remainder of panel 21.

Cover layer 83 (a) strengthens the weld between plug 82 and the remainder of panel 21 and (b) enhances the aesthetics of sport ball 10. More particularly, cover layer 83 covers the weld between plug 82 and the remainder of panel 21, thereby concealing and protecting the weld. Additionally, the weld between plug 82 and the remainder of panel 21 is spaced inward from the various seams 22 that join panels 21 together. Cover layer 83 may be colored, textured, or otherwise adorned in a manner that enhances the visual appeal of sport ball 10. In other configurations, cover layer 83 may also include (a) trademark information that identifies a manufacturer of sport ball 10 or (b) inflation instructions for sport ball 10, for example. Although an adhesive may be utilized to join cover layer 83 to sport ball 10, cover layer 83 may also be welded to the surface of sport ball 10. In some configurations, cover layer 83 may be a decal, appliqué, adhesive element, thermoplastic element, or a sticker that is secured over the weld between plug 82 and the remainder of panel 21.

Figure 19A:
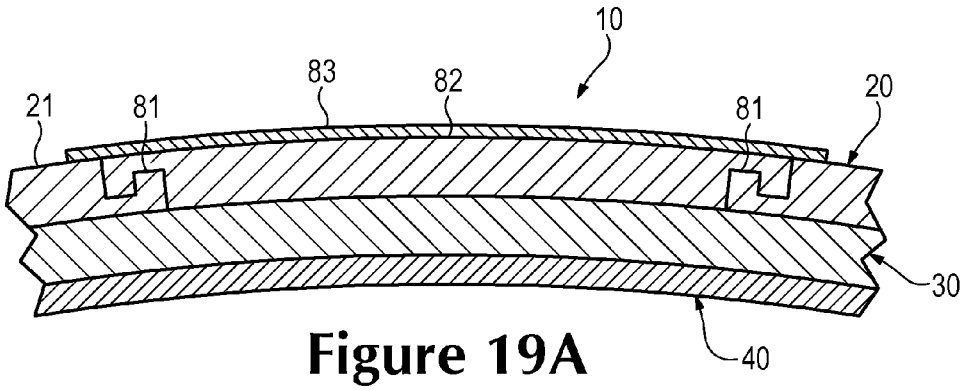
FIGS. 19A-19C are a cross-sectional views that corresponds with FIG. 18 and depict further configurations.
Figure 19B:
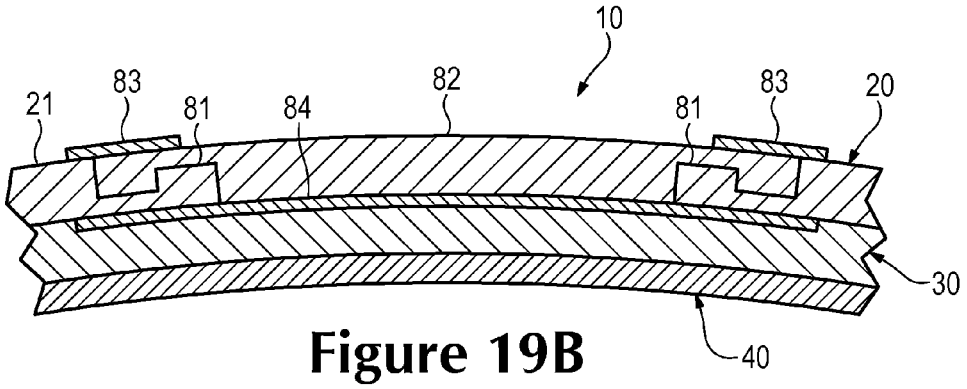
Figure 19C:
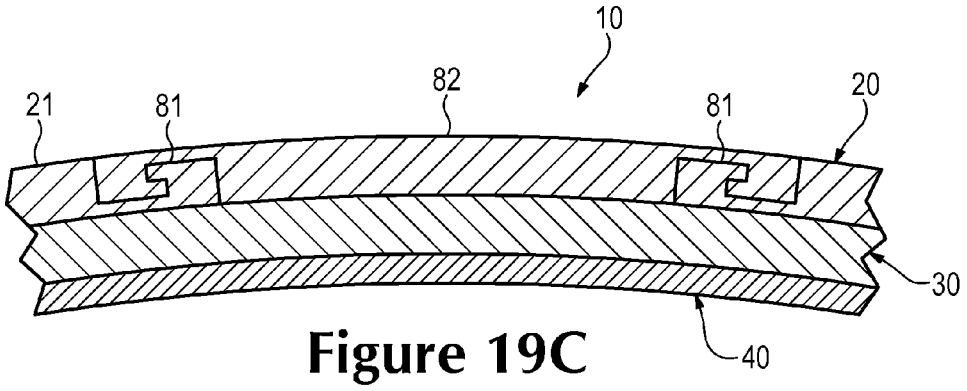

The shape and dimensions of cover layer 83 are generally selected to cover the weld between plug 82 and the remainder of panel 21. Referring to FIGS. 17 and 18, cover layer 83 has a generally circular configuration that covers the weld, but does not cover other areas of plug 82. In contrast, FIG. 19A depicts a configuration wherein cover layer 83 extends across the surface of plug 82 and covers substantially all of plug 82. In some configurations, a supplemental layer 84 may be placed between intermediate layer 30 and casing 20 to assist with bonding, as depicted in FIG. 19B. Although the configuration may vary, supplemental layer 84 may incorporate a thermoplastic polymer material that becomes welded to panel 21 and plug 82. In some configurations, as depicted in FIG. 19C, layers 83 and 84 may be absent from sport ball 10. Referring to FIG. 18, both the sides of aperture 81 and plug 82 have corresponding stepped configurations that mate and join in a relatively smooth manner. A variety of other configurations may also be utilized, as depicted in the cross-sectional views of FIG. 19A-19C, to impart greater strength or otherwise enhance the bond between aperture 81 and plug 82.

Figure 20:
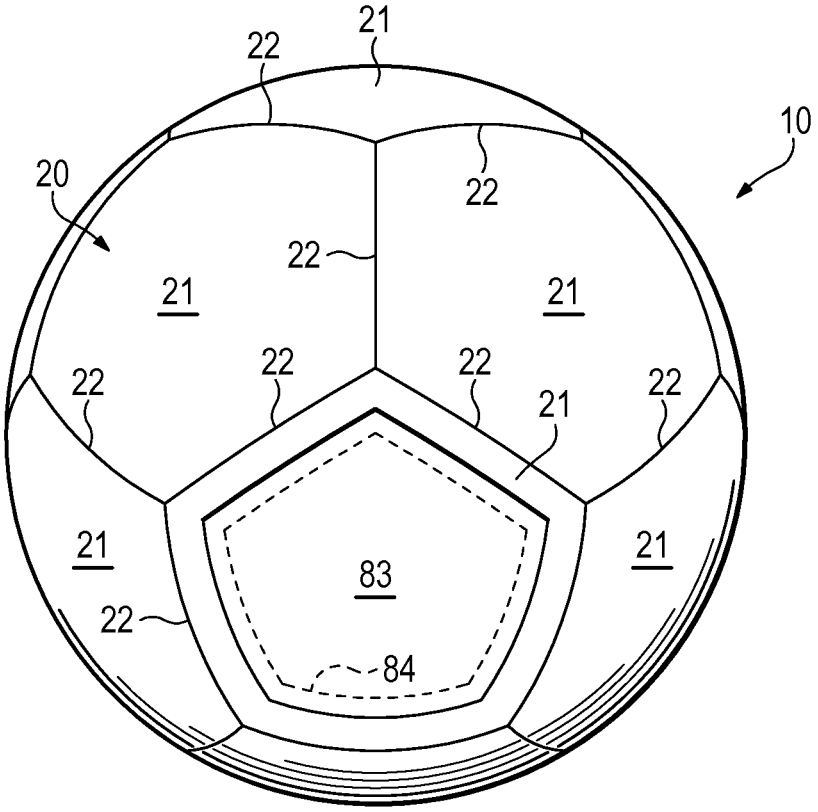
FIG. 20 is a perspective view of yet another configuration of the sport ball.

Although plug 82 may be separate from panel 21 and subsequently joined, a similar configuration may be achieved with the use of a flap 84, as depicted in FIG. 20. Whereas plug 82 is separate from panel 21, flap 84 is formed by cutting through panel 21 to form an opening that may be utilized to (a) reverse or turn casing 20 inside-out to place protruding flange areas 24 within casing 20 and (b) insert intermediate layer 30 and bladder 40 within casing 20. Once these are complete, flap 84 may be welded to close the opening. Additionally, the weld between flap 84 and the remainder of panel 21 is spaced inward from the various seams 22 that join panels 21 together. As depicted in FIG. 20, panels 21 have pentagonal shapes, flap 84 has a pentagonal shape, and cover layer 83 has a pentagonal shape that covers a majority of a surface of panel 21. An advantage to this configuration is that the area of the opening formed by flap 84 is maximized, thereby making the process of reversing casing 20 easier. In further configurations, cover layer 83 may only cover the area of the weld between flap 84 and the remainder of panel 21.

Based upon the above discussion, casing 20 may be at least partially formed by joining panels 21 through a welding process. In comparison with other methods of joining panels, the welding process may reduce the overall mass of sport ball 10 and increase manufacturing efficiency. Once the welding process is utilized to join panels 21, an opening in casing 20 may be utilized to reverse or turn casing inside-out to place protruding areas within sport ball 10, thereby forming a substantially smooth exterior surface. Additionally, intermediate layer 30 and bladder 40 may be inserted through the opening in casing 20, which is subsequently sealed.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A sport ball comprising:

a casing that forms an exterior surface of the sport ball and defines an interior of the sport ball, the casing incorporating a plurality of joined panel elements each including a first panel element and a second panel element;

wherein the first panel element has a first edge and a projection extending outwardly from the first edge;

wherein the second panel element has a second edge that is adjacent to the first edge;

an inflatable bladder disposed within the interior;

wherein the projection is disposed between the second edge and the inflatable bladder, and the first edge is joined to the second edge;

an intermediate layer having a limited degree of stretch disposed between the casing and the inflatable bladder; and a supplemental layer disposed between the intermediate layer and the casing and bonded to the first panel element and the second panel element;

wherein the projection contacts the supplemental layer.

2. The sport ball recited in claim 1, wherein the first edge and the second edge have rounded configurations that define an indentation between the first edge and the second edge.

3. The sport ball recited in claim 1, wherein the supplemental layer is adjacent to the first edge and the second edge and is welded to the first panel element and the second panel element.

4. The sport ball recited in claim 1, wherein the first panel element and the second panel element are formed from a thermoplastic polymer material.

5. The sport ball of claim 1, wherein the first edge is joined to the second edge with a weld.

6. The sport ball of claim 1, wherein the supplemental layer is adjacent to the first edge and the second edge and is joined to the first panel element and the second panel element with a weld.

* * * * *